US006689461B2

(12) United States Patent
Koyanagi et al.

(10) Patent No.: US 6,689,461 B2
(45) Date of Patent: Feb. 10, 2004

(54) FALSE TWISTED YARN OF POLYESTER COMPOSITE FIBER AND METHOD FOR PRODUCTION THEREOF

(75) Inventors: Tadashi Koyanagi, Nobeoka (JP); Takao Abe, Nobeoka (JP); Teruhiko Matsuo, Nobeoka (JP); Mitsuyuki Yamamoto, Kanazawa (JP)

(73) Assignee: Asahi Kasei Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/122,296

(22) Filed: Apr. 16, 2002

(65) Prior Publication Data

US 2003/0052436 A1 Mar. 20, 2003

(30) Foreign Application Priority Data

| | | |
|---|---|---|
| Apr. 17, 2001 | (JP) | 2001-117915 |
| Oct. 26, 2001 | (JP) | 2001-328870 |
| Nov. 22, 2001 | (JP) | 2001-356975 |
| Feb. 8, 2002 | (JP) | 2002-031639 |

(51) Int. Cl.[7] ..... D01F 6/00; D01F 6/62
(52) U.S. Cl. ..... 428/364; 428/395; 57/243
(58) Field of Search ..... 428/364, 395; 57/243; 264/130, 210.3

(56) References Cited

U.S. PATENT DOCUMENTS

| | | | | |
|---|---|---|---|---|
| 3,671,379 A | | 6/1972 | Evans et al. | 161/173 |
| 6,306,499 B1 | | 10/2001 | Ochi et al. | 428/364 |
| 6,572,967 B1 | * | 6/2003 | Abe et al. | 428/364 |

FOREIGN PATENT DOCUMENTS

| | | |
|---|---|---|
| EP | 1 059 372 A2 | 12/2000 |
| GB | 965729 | 8/1964 |
| JP | 58104216 A | 6/1983 |
| JP | 10072732 A | 3/1998 |
| JP | 11107081 | 4/1999 |
| JP | 11172536 A | 6/1999 |
| JP | 11189923 A | 7/1999 |
| JP | 2000239927 A | 9/2000 |
| JP | 2000256918 | 9/2000 |
| JP | 2000256918 A | 9/2000 |
| JP | 2000256925 | 9/2000 |
| JP | 2001020136 A | 1/2001 |
| JP | 2001040537 A | 2/2001 |
| JP | 2001040537 | 2/2001 |
| JP | 3204399 | 9/2001 |
| JP | 2002054029 A | 2/2002 |
| JP | 2002061031 A | 2/2002 |
| JP | 2002-88570 | 3/2002 |
| JP | 2002-88586 | 3/2002 |
| WO | WO 00/47507 | 8/2000 |
| WO | WO 01/53573 A1 | 7/2001 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The invention provides false twisted yarn of a polyester composite fiber characterized in that the fiber is composed of single-filaments which are laminated with two types of polyester components in a side-by-side or eccentrical core/sheath fashion, at least one of the two polyester components is poly(trimethylene terephthalate), the difference in intrinsic viscosity between the two polyester components is 0.05–0.9 (dl/g), and the false twisted yarn has latent crimpability and has at least 50% stretching elongation of developed crimps prior to boiling water treatment.

18 Claims, 7 Drawing Sheets

FALSE TWISTED YARN OF POLYESTER COMPOSITE FIBER AND METHOD FOR PRODUCTION THEREOF

TECHNICAL FIELD

The present invention relates to a false-twisted yarn of a polyester composite fiber, which can be used for knitted or woven fabrics.

BACKGROUND ART

In recent years there has been a strong demand for stretch knitted or woven fabrics exhibiting an excellent stretch performance and a wearable feel.

This demand has been met by the use of numerous stretchable knitted or woven fabrics obtained by mixing, for example, polyurethane fiber with polyester fiber or the like.

However, polyurethane fiber is problematic in that it is not easily dyed with polyester fiber disperse dyes and therefore requires a more complex dyeing process, while it also becomes brittle and loses its stretch properties with prolonged use.

It has been attempted to avoid such problems by investigating the use of a crimped yarn of polyester fiber instead of a polyurethane fiber.

Crimped yarn is a term including bulky yarn obtained by mechanical working of drawn yarn or partially oriented yarn (POY), and self-crimping yarn achieved by adhering two types of polymers in a side-by-side or eccentrical fashion and crimping them.

False twisted yarn is a typical type of bulky yarn of poly(trimethylene terephthalate) (hereunder, "PTT"). Such yarn is described in numerous published documents including Kohyo (National Patent Publication of Translated Version) No. 9-509225, Japanese Unexamined Patent Publication SHO No. 58-104216, Japanese Unexamined Patent Publication SHO No. 11-172536, Japanese Unexamined Patent Publication No. 2001-20136 and WO00/47507, and Chemical Fibers International, Vol.47, pp.72–74 (published 2/1997).

PTT false twisted yarn includes single heater stretch yarn obtained directly by crimping or draw crimping, and double heater set yarn obtained by further heat treatment of single heater stretch yarn.

Single heater stretch yarn has residual torque, and with further heat treatment the crimping is augmented and hardened to give false twisted yarn with latent crimpability. Double heater set yarn is obtained by development of crimps by thermosetting, and such textured yarn has low residual torque.

Single heater false twisted yarn having latent crimpability and a high crimp development property is normally used in woven fabrics, but when it resides in a woven fabric with strong binding force due to the fabric texture, or when it has been subjected to a strong load, it often fails to exhibit adequate crimping even if the cloth is subjected to heat treatment or other steps.

For example, when conventional PTT false twisted yarn is used as the warp yarn for a woven fabric, the strong binding force of the fabric texture prevents expression of adequate crimping and, therefore, a fabric with an excellent stretch property (or, stretchability) cannot be obtained.

Double heater false twisted yarn with dense crimping and few surface irregularities is commonly used for cloths such as knitted fabrics with relatively low texture binding force, but when conventional PTT false twisted yarn is used, stretchability is obtained but little of the free-movement property of cloths employing polyurethane fiber is exhibited.

On the other hand, side-by-side crimped yarn is a typical type of self-crimping yarn of PTT fiber, and the relevant prior art includes Japanese Examined Patent Publication SHO No. 43-19108, Japanese Unexamined Patent Publication No. 2000-239927, Japanese Unexamined Patent Publication No. 2000-256918, Japanese Unexamined Patent Publication No. 2001-55634, European Patent (EP) No. 1059372, Japanese Unexamined Patent Publication No. 2001-40537, Japanese Unexamined Patent Publication No. 2001-131837, Japanese Unexamined Patent Publication No. 2002-61031, Japanese Unexamined Patent Publication No. 2002-54029 and U.S. Pat. No. 6,306,499.

In these documents there is proposed either the use of PTT for at least one of the components, or else the use of PTT with different intrinsic viscosity for side-by-side or eccentric core-sheath two-component composite fiber (hereunder both collectively referred to as "PTT composite fibers"; PTT composite fiber is also called as PTT conjugate fiber). Such PTT composite fibers are characterized by having a soft feel and satisfactory crimp development property. The aforementioned prior art documents teach that such fibers have stretch properties and elongation recovery, and that these properties can be utilized for application in various stretch knitted or woven fabrics or bulky knitted or woven fabrics.

However, conventional PTT composite fibers have been found to have the following problems.

(i) Crimp Development Property

Because of the weak crimp development property of conventional PTT composite fibers, excellent stretchability cannot be obtained when they are used for woven fabrics with strong binding force due to the texture. That is, although adequate crimping is expressed in the absence of a load, adequate crimping cannot be expressed even with heat treatment in the presence of binding as exists in a woven fabric or under a load.

In order to compensate for the weak crimp development property and to express adequate stretchability, it has been necessary to first produce a wide knitted or woven fabric, and then release the binding or load during heat treatment, which results in significantly shrinkage of the fabric width. It cannot be denied that this method is economically disadvantageous because of the reduced cloth width.

When a conventional PTT composite fiber is used directly in a knitted or woven fabric, craping irregularities are produced on the surface of the cloth product, resulting in impaired surface quality. In order to improve the surface quality, twisting is carried out at 500–2000 turns/m but, although the surface craping is reduced with greater twisting such that the surface quality is improved to some degree, a drawback is that the crimpability is reduced.

Thus, while conventional PTT composite fibers exhibit stretch properties and an elongation recovery comparable to elastic fibers if heat treated in the absence of a load, when they are actually used in a cloth, their weak crimp development property limits their use for woven fabrics with strong fiber binding.

It has also been considered to combine false twisting with such polyester composite fibers in order to compensate for the weakness of the crimp development property of the fibers.

Publicly known poly(ethylene terephthalate) composite fibers, when subjected simply to false twisting, do not exhibit a crimpability exceeding false twisting of the individual component fibers of the composite fiber. (See, for example, "Filament Texturing Technology Manual" ed. by The Textile Machinery Society of Japan, p.190: 1976.)

Japanese Unexamined Patent Publication No. 2000-256918 discloses a technique whereby an eccentric core-sheath composite fiber comprising as one of the components PTT obtained by copolymerization of three-dimensional crosslinkable trifunctional components, is subjected to false twisting to develop crimps. This publication, however, merely mentions crimping of latent crimped yarn as one means of development, and neither discloses nor suggests an improvement in the crimp development property. Also, the PTT fiber obtained by copolymerization of crosslinking components disclosed in this publication has poor long-term spinning stability, and this has therefore hampered industrial operations. In addition, because of the effect of the crosslinking components, the breaking elongation of the false twisted yarn is less than 25%, resulting in more yarn breakage during false twisting and thus hampered industrial operation.

(ii) False Twisting Property

Surprisingly, it has been shown that for false twisting of conventional PTT composite fiber, yarn breakage increases during false twisting as the false twisting time proceeds.

When the cause of this was investigated, it was found to be that trimethylene terephthalate cyclic dimers in the fiber sublimate during false twisting and attach to, and accumulate on, the guides.

It is surmised that the lower degree of molecular orientation of side-by-side composite fiber comprising PTT as compared with fiber composed of simple polymers causes the trimethylene terephthalate cyclic dimers in the fiber to readily sublimate during false twisting.

(iii) Dyeing Problems

Known dyeing methods for knitted or woven fabrics include piece dyeing methods and print dyeing methods, as well as yarn dyeing methods.

Knitted or woven fabrics obtained by yarn dyeing methods have patterns formed by the different color distributions of the respective fibers, and are therefore characterized by allowing knitted or woven fabrics with high quality feel or fashion to be obtained. Yarn dyeing methods include methods of dyeing after reeling and dyeing after cheese winding, but the latter are most commonly used from the standpoint of dyeing economy.

Knitted or woven fabrics obtained by yarn dyeing of PTT twisted yarn by cheese dyeing (hereinafter referred to simply as "cheese dyeing") are more suited to crimp development during dyeing, as compared to false twisted yarn made of PTT or poly(ethylene terephthalate) (hereinafter, "PET"). Consequently, when yarn dyed PTT false twisted yarn is used in knitted fabrics, satisfactory stretchability is characteristically obtained due to the high crimpability.

Despite this characteristic, however, it has been found that with cheese-dyeing of PTT false twisted yarn, the oligomers extracted from the textured yarn are deposited on the dyeing cheese, thus impairing the dyeing uniformity.

Specifically, when the dyeing solution circulates through the cheese from the inside to the outside of the cheese, the oligomers which have dissolved from the PTT false twisted yarn into the dyeing solution are deposited, adhering to the textured yarn. This creates the problem of production of uneven dyeing or dark coloration at the sections of the textured yarn at which the oligomers have adhered. This dyeing problem caused by oligomers is not limited to yarn dyeing, but also occurs with piece dyeing.

Analysis by the present inventors has shown that the major components of the oligomers are trimethylene terephthalate cyclic dimers.

The reason for the large amount of deposition of cyclic dimers with PTT false twisted yarn is not well understood, but it is conjectured that the low degree of orientation of PTT in PTT false twisted yarn facilitates movement of cyclic dimers to the textured yarn surface.

Japanese Patent Publication No. 3204399 discloses PTT fiber with a limited oligomer content in order to control spinneret discharge port contamination. However, its content is still high, and the dyeing problems which occur when dyeing PTT false twisted yarn are not addressed.

As explained above, there has been a demand for a composite fiber that exhibits an excellent crimp development property and high elongation recovery property even under the typically high load conditions for fabrics. There has also been a demand for a composite fiber with both excellent surface quality and high elongation recovery even when used for knitted fabrics. In addition, a strong demand exists for a method of stable production of both such a composite fiber and its false twisted yarn on an industrial scale, which does not entail dyeing problems.

Disclosure of the Invention

It is an object of the present invention to provide false twisted yarn of polyester composite fiber which can provide superior stretchability and quick stretch recovery when used for clothes, i.e., which can give knitted or woven fabrics with excellent free-movement properties. It is another object of the invention to provide a method for stable industrial production of a false twisted yarn of polyester composite fiber which is not susceptible to trouble during dyeing, which method allows satisfactory process throughput during twisting and produces no yarn breakage.

The first problem to be solved by the invention is to eliminate the reduction in crimp development property under high loads or the lack of extension recovery, which is the drawback of PTT simple fiber false twisted yarn or conventional PTT composite fibers. The second problem is to eliminate trouble during dyeing caused by oligomers, for false twisted yarn obtained by false twisting PTT composite fiber. The third problem is to eliminate yarn breakage during false twisting of the aforementioned false twisted yarn made of PTT composite fiber.

Specifically, the present invention provides the following.

1. False twisted yarn of polyester composite fiber characterized by satisfying the following conditions (1) to (5).
   - (1) The composite fiber is composed of single filaments with two polyester components laminated in a side-by-side manner or core-sheath manner.
   - (2) At least one of the components of the two polyester components composing the single filaments is PTT.
   - (3) The difference in intrinsic viscosity between the two polyester components is 0.05–0.9 (dl/g).
   - (4) It has latent crimpability.
   - (5) It has at least 50% stretching elongation of developed crimps prior to boiling water treatment.

2. False twisted yarn of polyester composite fiber according to 1. above, characterized in that the mean intrinsic viscosity of the composite fiber is 0.6–1.2 (dl/g).

3. False twisted yarn of polyester composite fiber characterized by satisfying the following conditions (1) to (6).
   - (1) The composite fiber is composed of single filaments with two polyester components laminated in a side-by-side manner or core-sheath manner.
   - (2) At least one of the components of the two polyester components composing the single filaments is PTT.

(3) It has 50–300% stretching elongation of developed crimps prior to boiling water treatment.

(4) The relationship between the load X ($\times 10^{-3}$ cN/dtex) during boiling water treatment and the crimp factor Y (%) after boiling water treatment satisfies the inequality $-10X+60 \leqq Y \leqq 80$ (provided that $1 \leqq X \leqq 4$).

(5) The elongation recovery speed of the false twisted yarn after boiling water treatment is 15–50 m/sec.

(6) The breaking elongation of the false twisted yarn before boiling water treatment is 25% or greater.

4. False twisted yarn of polyester composite fiber according to 1., 2. or 3. above, characterized in that the PTT is either a PTT homopolymer or a copolymer containing no more than 10 mole percent of repeating ester units other than repeating trimethylene terephthalate units.

5. False twisted yarn of polyester composite fiber according to any one of 1. to 4. above, characterized in that the stretching elongation of developed crimps prior to boiling water treatment is 70–300%.

6. False twisted yarn of polyester composite fiber according to any one of 1. to 5. above, characterized in that the crimp factor measured after boiling water treatment with a load of $3\times10^{-3}$ cN/dtex is 35% or greater.

7. False twisted yarn of polyester composite fiber characterized by satisfying the following conditions (1) to (7).

(1) The composite fiber is composed of single filaments with two polyester components laminated in a side-by-side manner or core-sheath manner.

(2) At least one of the components of the two polyester components composing the single filaments is PTT.

(3) The PTT is either a PTT homopolymer or a copolymer containing no more than 10 mole percent of repeating ester units other than repeating trimethylene terephthalate units.

(4) The untwisting torque is no greater than 100 turns/m.

(5) The relationship between the load X ($\times 10^{-3}$ cN/dtex) during boiling water treatment and the crimp factor Y (%) after boiling water treatment satisfies the inequality $-10X+60 \leqq Y \leqq 80$ (provided that $1 \leqq X \leqq 4$).

(6) The elongation recovery speed of the false twisted yarn after boiling water treatment is 15–50 m/sec.

(7) The breaking elongation of the false twisted yarn before boiling water treatment is 25% or greater.

8. False twisted yarn of polyester composite fiber according to 7. above which is suitable for knitted fabrics, characterized in that the crimp factor measured after boiling water treatment with a load of $3\times10^{-3}$ cN/dtex is 30% or greater.

9. False twisted yarn of polyester composite fiber according to any one of 1. to 8. above, characterized in that the other polyester component is PET, poly(propylene terephthalate) or poly(butylene terephthalate).

10. False twisted yarn of polyester composite fiber according to any one of 1. to 9. above, characterized in that the PTT contains no trifunctional components.

11. False twisted yarn of polyester composite fiber according to any one of 1. to 10. above, characterized in that the content of trimethylene terephthalate cyclic dimers in the false twisted yarn is no greater than 2.5 wt %.

12. False twisted yarn of polyester composite fiber according to any one of 1. to 11. above, characterized in that the fiber size fluctuation value (U %) of the false twisted yarn is no greater than 1.5%.

13. A knitted or woven fabric employing false twisted yarn of polyester composite fiber according to any one of 1. to 12. above for all or a portion thereof.

14. A method for production of false twisted yarn of polyester composite fiber characterized by satisfying the following conditions (1) to (6).

(1) The composite fiber is composed of single filaments with two polyester components laminated in a side-by-side manner or core-sheath manner.

(2) The difference in intrinsic viscosity between the two polyester components is 0.1–0.8 (dl/g).

(3) At least one of the components of the two polyester components is PTT.

(4) The content of trimethylene terephthalate cyclic dimers in the false twisted yarn is no greater than 2.5 wt %.

(5) The polyester is discharged from a spinneret with the discharge port inclined at an angle of 10–40° with respect to the vertical direction and then, after cooling to solidification, is taken up either with or without drawing to obtain composite fiber.

(6) The obtained composite fiber is false twisted at a yarn temperature of 140–190° C. during the false twisting.

15. A method for production of false twisted yarn of polyester composite fiber characterized by satisfying the following conditions (1) to (8).

(1) The composite fiber is composed of single filaments with two polyester components laminated in a side-by-side manner or core-sheath manner.

(2) The difference in intrinsic viscosity between the two polyester components is 0.1–0.8 (dl/g).

(3) At least one of the components of the two polyester components is PTT.

(4) The content of trimethylene terephthalate cyclic dimers in the false twisted yarn is no greater than 2.5 wt %.

(5) The polyester is discharged from a spinneret with the discharge port inclined at an angle of 10–40° with respect to the vertical direction and then, after cooling to solidification, is taken up either with or without drawing to obtain composite fiber.

(6) The obtained composite fiber is false twisted by a double heater method.

(7) The overfeed ratio in the second heater is −10 to +5%.

(8) The yarn temperature during false twisting is 140–190° C.

16. A method for production of false twisted yarn of polyester composite fiber characterized by satisfying the following conditions (1) to (6).

(1) The composite fiber is composed of single filaments with two polyester components laminated in a side-by-side manner or core-sheath manner.

(2) The difference in intrinsic viscosity between the two polyester components is 0.1–0.8 (dl/g).

(3) Both of the two polyester components are PTT.

(4) The PTT contains no trifunctional components.

(5) The mean intrinsic viscosity of the composite fiber is 0.6–1.2 (dl/g).

(6) False twisting is performed using composite fiber selected from among the following (a) to (c).

(a) Composite fiber wound into a pirn shape, having a breaking elongation of 25–50% and a dry heat shrinkage extreme stress of 0.10–0.30 cN/dtex.

(b) Composite fiber wound into a cheese shape, having a breaking elongation of 30–80% and a dry heat shrinkage extreme stress of 0–0.20 cN/dtex.

(c) Undrawn composite fiber wound into a cheese shape, having a breaking elongation of 50–120%, a dry heat shrinkage extreme stress of 0–0.15 cN/dtex and a boiling water shrinkage of 1–10%.

17. A method for production of false twisted yarn of polyester composite fiber according to any one of 14. to 16. above, characterized by satisfying the following conditions (1) to (4).

(1) The two polyester components are both PTT homopolymers.

(2) The difference in intrinsic viscosity between the two polyester components is 0.3–0.5 (dl/g).

(3) The homopolymers are discharged from a spinneret with the discharge port inclined at an angle of 20–40° with respect to the vertical direction to obtain composite fiber.

(4) The obtained composite fiber is false twisted.

18. A method for production of false twisted yarn of polyester composite fiber according to any one of 14. to 17. above, characterized in that both of the two polyester components are PTT homopolymers with a trimethylene terephthalate cyclic dimer content of no greater than 2.5 wt %.

The present invention will now be explained in greater detail.

According to the invention, the composite fiber is composed of single filaments with two polyester components laminated in a side-by-side manner or a core-sheath manner. That is, the positioning of the two polyesters is such that they are laminated in a side-by-side manner along the length of the single filaments, or else all or a portion of one of the polyester components is surrounded by the other polyester component, resulting core-sheath composite fiber having a fiber cross-section in which both are situated eccentrically. The side-by-side manner is preferred.

The difference in intrinsic viscosity of the two polyester components is 0.05–0.9 dl/g, preferably 0.1–0.8 dl/g, more preferably 0.1–0.5 dl/g and even more preferably 0.3–0.5 dl/g. A difference in intrinsic viscosity within this range will give adequate crimpability and extension recovery, with virtually no yarn bending during discharge or contamination of the discharge port even if the spinneret design or discharge conditions are changed during spinning of the composite fiber, while the fiber size fluctuation of the false twisted yarn is also reduced.

According to the invention, the blending ratio of the two polyester components with different intrinsic viscosities in the single filament cross-section is preferably 40/60 to 70/30 and more preferably 45/55 to 65/35 as the proportion of the high viscosity component to the low viscosity component. A ratio in this range will give strength of at least 2.5 cN/dtex and excellent crimpability suitable for sports uses.

According to the invention, at least one of the two polyester components composing the single filaments is PTT. That is, the combination of polyester components may be a combination of PTT with a polyester other than PTT, or a combination of PTT components.

The PTT may be a PTT homopolymer, or it may be copolymer PTT containing no more than 10 mole percent of repeating ester units other than repeating trimethylene terephthalate units.

The following may be mentioned as typical examples of copolymerizing components for copolymer PTT.

Acidic components include aromatic dicarboxylic acids represented by isophthalic acid and 5-sodiumsulfoisophthalic acid, and aliphatic dicarboxylic acids represented by adipic acid and itaconic acid. Glycolic components include ethylene glycol, butylene glycol, polyethylene glycol and the like. Hydroxycarboxylic acids such as hydroxybenzoic acid are further examples. A plurality of these may also be copolymerized.

According to the invention, one of the two polyester components composing the single filaments is preferably PTT while the other component is PET or poly(butylene terephthalate) (hereinafter, "PBT"), or a third copolymerized component, with PBT being preferred.

As typical third components for copolymerization there may be mentioned the following. Acidic components include aromatic dicarboxylic acids represented by isophthalic acid and 5-sodiumsulfoisophthalic acid, and aliphatic dicarboxylic acids represented by adipic acid and itaconic acid. Glycolic components include ethylene glycol, butylene glycol, polyethylene glycol and the like. Hydroxycarboxylic acids such as hydroxybenzoic acid are further examples. A plurality of these may also be copolymerized.

According to the invention, the mean intrinsic viscosity of the composite fiber is preferably 0.6–1.2 dl/g and more preferably 0.7–1.2 dl/g. A mean intrinsic viscosity within this range will result in sufficient false twisted yarn strength and thus cloths with excellent mechanical strength that can be suitably employed for sports uses and the like which require high strength, while stable production is also facilitated since yarn breakage does not occur during the false twisted yarn production process.

The method for production of the PTT used for the invention is not particularly restricted, and any publicly known method may be applied. For example, there may be mentioned a single-stage method which achieves a degree of polymerization corresponding to the prescribed intrinsic viscosity by melt polymerization alone, or a two-stage method whereby the degree of polymerization is increased by melt polymerization up to a prescribed intrinsic viscosity, and then the degree of polymerization is increased to correspond to the prescribed intrinsic viscosity by solid-state polymerization.

According to the invention, the latter two-stage method which combines solid-state polymerization is preferably applied in order to reduce the cyclic dimer content of the PTT. When PTT is produced by a single-stage method, the obtained PTT is preferably supplied to a spinning step after reducing the cyclic dimers by extraction treatment or the like.

The PTT used for the invention preferably has a trimethylene terephthalate cyclic dimer content of no greater than 2.5 wt %, more preferably no greater than 1.1 wt % and more preferably no greater than 1.0 wt %. A smaller cyclic dimer content is preferred, and it may even be 0%. A cyclic dimer content of 2.5 wt % or less will result in a content of no greater than 2.5 wt % in the false twisted yarn, as will be explained below, thereby eliminating trouble during false twisting and dyeing.

The PTT used for the invention preferably contains no trifunctional components. When trifunctional components are present, the PTT chains become branched and the crystal orientation of the fiber is reduced. As trifunctional components there may be mentioned trimethylolpropane, pentaerythritol, trimellitic acid and pyromellitic acid.

According to the invention, the two polyester components composing the single filaments are both preferably PTT in order to obtain excellent instantaneous recovery. When both of the components are PTT, the content of trimethylene terephthalate cyclic dimers is preferably no greater than 1.1 wt % for both PTT components, in order to reduce yarn breakage due to cyclic dimer deposition during false twisting.

The false twisted yarn of polyester composite fiber according to the invention not only has crimps (i.e. developed crimps) produced by false twisting of the polyester composite fiber, but also exhibits latent crimpability. Latent crimpability is crimping that is developed by heat treatment of false twisted yarn. The heat treatment is, for example, treatment in boiling water, heating during the dyeing step or heating during other steps, and the heat treatment may be carried out at the fiber stage or the cloth stage.

The false twisted yarn of the invention has at least 50%, preferably 50–300%, more preferably 60–300% and even more preferably 70–300% stretching elongation of developed crimps prior to boiling water treatment. If the stretching elongation of developed crimps prior to boiling water treatment is at least 50%, then high crimp development property will be achieved by boiling water treatment even for a cloth with strong binding force such as woven fabrics, and therefore a cloth with excellent stretchability and instantaneous elongation recovery is obtained. Stretching elongation of about 300% is the limit for the current state of the art.

Since the stretching elongation of developed crimps prior to boiling water treatment is at most 20% for conventional PET false twisted yarn (See "Filament Texturing Technology Manual" ed. by The Textile Machinery Society of Japan, p.191: 1976), the stretching elongation of the false twisted yarn of the invention may be considered extremely high.

When PTT false twisted yarn according to the invention is used as weft for a woven fabric, a greige with stretchability even before water boiling treatment is obtained. This has never been achieved when using publicly known false twisted yarn or latent crimping composite fibers.

Another industrial advantage of the high stretching elongation of developed crimps prior to water boiling treatment is that it is possible to obtain cloths with high stretchability without performing full-width widening by heat treatment during the process from knitted or woven fabric greige to product, such that an economical advantage is also provided. Moreover, since sudden shrinkage by heat treatment is controlled, craping irregularities are not produced on knitted fabric surfaces, thus providing the advantage of giving knitted fabrics with satisfactory surface qualities.

For false twisted yarn according to the invention, the relationship between the load X ($\times 10^{-3}$ cN/dtex) during boiling water treatment and the crimp factor Y (%) after boiling water treatment satisfies the inequality—$10X+60 \leqq Y \leqq 80$ (provided that $1 \leqq X \leqq 4$).

For the load X, the load to which the cloth is subjected during scouring or dyeing of knitted or woven fabric is assumed to be in the range of $1\times10^{-3}$ to $4\times10^{-3}$ cN/dtex. The false twisted yarn of the invention exhibits a high crimp factor within this range of load.

The range represented by the aforementioned relational equation for X and Y is illustrated by the shaded area in FIG. 1. In FIG. 1, the horizontal axis represents the load X ($\times 10^{-3}$ cN/dtex) applied to the false twisted yarn during boiling water treatment, and the vertical axis represents the crimp factor Y (%) of the false twisted yarn after boiling water treatment.

As seen by the shaded area in FIG. 1, the false twisted yarn of the invention has a high crimp factor, i.e., high crimp development property even when a load is large. For example, with boiling water treatment under a load of $3\times10^{-3}$ cN/dtex, the crimp factor of the false twisted yarn of the invention is seen to be 30% or higher. Cloth having such a high crimp factor exhibits excellent stretchability.

The crimp factor Y is more preferably 35% or greater and even more preferably 40% or greater. A higher crimp factor Y is preferred, but approximately 80% is the upper limit for the current state of the art.

The specific excellence of the crimp development property of the false twisted yarn of the invention will now be further explained with reference to FIGS. 2*a*, 2*b*, 3*a* and 3*b*.

FIG. 2*a* is a scanning electron microscope photograph of the crimp form of the false twisted yarn obtained in Example 1 according to the invention after boiling water treatment in the absence of a load, and FIG. 2*b* is the same of the crimp form after boiling water treatment under a load of $3\times10^{-3}$ cN/dtex.

For comparison, FIG. 3*a* is a scanning electron microscope photograph of the crimp form of false twisted yarn of simple fiber composed of PTT alone as in Comparative Example 7, after boiling water treatment in the absence of a load, and FIG. 3*b* is the same of the crimp form after boiling water treatment under a load of $3\times10^{-3}$ cN/dtex.

As is clearly seen from these photographs, the false twisted yarn of the invention expresses fine crimping upon boiling water treatment in the absence of a load (FIG. 2*a*) as expected, but also expresses numerous crimps even under a load of $3\times10^{-3}$ cN/dtex (FIG. 2*b*). In contrast, the false twisted yarn of simple fiber composed of PTT alone expresses fine crimping upon boiling water treatment in the absence of a load (FIG. 3*a*), but expresses few crimps under a load of $3\times10^{-3}$ cN/dtex (FIG. 3*b*). In other words, this shows that the false twisted yarn of the invention has higher crimp development property than conventional false twisted yarn.

The high crimp development property of the false twisted yarn of the invention even under load means that it expresses excellent crimping even when it is used in woven fabrics with strong binding force due their texture, and can therefore give fabrics with excellent stretchability and stretchback properties.

The false twisted yarn of the invention has an elongation recovery speed of preferably 15–50 m/sec and more preferably 15–30 m/sec after boiling water treatment.

The elongation recovery speed is for false twisted yarn which has been subjected to boiling water treatment in the absence of a load, stretched to a prescribed stress and then cut, and it is the speed at which the length of the stretched false twisted yarn instantaneously recovers. This measuring method is a method first proposed by the present inventors, and it is the first method to allow quantitative measurement of stretchback properties. A detailed explanation of the measuring method will follow.

When the elongation recovery speed after boiling water treatment is within the above range, rapid stretch recovery, i.e. an excellent free-movement property, is exhibited for clothes.

In order to obtain knitted or woven fabrics with excellent free-movement properties, the elongation recovery speed after boiling water treatment is preferably 15 m/sec or greater and more preferably 20 m/sec or greater for knitted fabric textures, or 20 m/sec or greater and more preferably 25 m/sec or greater for woven fabric textures. Yarn with elongation recovery speed exceeding 50 m/sec is difficult to produce with the current state of the art.

According to the measuring method described above, the elongation recovery speed of publicly known PET false twisted yarn is about 10 m/sec, and the elongation recovery speed of publicly known false twisted yarn of PTT fiber alone is about 15 m/sec. Considering that the elongation recovery speed of publicly known Spandex elastic fiber is 30–50 m/sec, it will be appreciated that the false twisted yarn of the invention has a high elongation recovery comparable to Spandex elastic fiber.

The false twisted yarn of the invention has an untwisting torque of preferably no greater than 100 turns/m and more preferably no greater than 80 turns/m. An untwisting torque of under 100 turns/m will give knitted fabrics with no surface irregularities and satisfactory surface quality.

In particular, since knitted fabrics have lower textural binding force than woven fabrics, stretchability will be imparted to some degree simply by the knitted texture itself. Thus, the crimping property of the false twisted yarn may be lower than for woven fabrics, and instead, as satisfactory surface knitted quality is necessary, advantages are afforded if the untwisting torque is in the range described above.

The size of the false twisted yarn of the invention and the single-filament size are not particularly restricted, but preferably the size is 20–300 dtex and the single-filament size is 0.5–20 dtex. Also, the single-filament cross-sectional shape may have a circular shape, an irregular shape such as a Y-shape or W-shape, or a hollow cross-sectional shape.

The breaking elongation of the false twisted yarn of the invention is preferably at least 25% and more preferably 30–60%. A breaking elongation of at least 25% will result in no crimping uneveness and low fluff generation and yarn breakage during production of the false twisted yarn or during texturing of produced knitted or woven fabrics.

The breaking strength of the PTT false twisted yarn of the invention is preferably at least 2 cN/dtex and more preferably at least 2.2 cN/dtex. A breaking strength of at least 2 cN/dtex will result in knitted fabrics with adequate strength and durability that can be used in a wide range of fields.

The PTT false twisted yarn of the invention has a fiber size fluctuation value (U %) of preferably no greater than 1.5% and more preferably 0.5–1.5%. A U % value of 1.5% or less will result in knitted or woven fabrics with excellent quality irrespective of their texture.

The PTT false twisted yarn of the invention preferably contains a finishing agent at 0.2–2 wt % for the purpose of imparting smoothness, cohesion, electrostatic properties and the like. If necessary, intermingling may be imparted at 1–50 nodes/m.

A knitted or woven fabric using false twisted yarn according to the invention has very excellent stretchability, rapid stretch recovery, i.e., an excellent free-movement property, and satisfactory quality without craping defect or dyeing uneveness.

As fabric textures there may be used plain weave textures, twill weave textures and satin weave textures, as well as various types of texture variations derived therefrom.

In the case of a woven fabric, the false twisted yarn of the invention may be used as the warp alone, the weft alone or both the warp and the weft.

The stretch factor of the woven fabric is preferably 10% or greater, more preferably 20% or greater, and even more preferably 25% or greater. A woven fabric with a stretch factor of 20% or greater exhibits a particularly satisfactory instantaneous free-movement property for local instantaneous movement displacement when used for sports wear and the like, so that the effect of the invention may be exhibited even more effectively.

The elongation recovery of the woven fabric is preferably 80–100% and more preferably 85–100%.

Because a woven fabric using false twisted yarn according to the invention has low elongation stress when the fabric is stretched, the tightness during wear is low such that a comfortable feel is exhibited, thereby reducing fatigue even with prolonged wear. A comfortable feel due to low wearing tightness is obtained if the elongation stress is, for example, a stress of no greater than 150 cN/cm with 20% elongation. A stress of 50–100 cN/cm with a 20% elongation is more preferred.

Since woven fabrics using false twisted yarn according to the invention have an excellent free-movement property, they are resistant to wrinkling behind the knee or around the hips when used for slacks or skirts. This renders them highly suitable for slacks, skirts, uniforms and the like.

For knitted fabrics, the false twisted yarn of the invention may be applied for numerous types of knitted fabrics including warp-knitted fabrics, weft-knitted fabrics, and the like. For example, they are highly suitable for jerseys, swimwear, stockings and the like. Such products exhibit excellent characteristics in terms of wearing feel and free-movement properties comparable to knitted fabrics employing Spandex fiber.

When false twisted yarn according to the invention is used in a knitted or woven fabric, it may remain untwisted or it may be interlaced or twisted for increased cohesion. Twisting may be imparted either in the same direction or the opposite direction as that of the false twisting. The twisting coefficient is preferably no greater than 5000.

The twisting coefficient k is represented by the following equation, where T represents the number of twists.

$$T\ (\text{turns}/m)=k/\{\text{size of false twisted yarn (dtex)}\}^{1/2}$$

The false twisted yarn of the invention will exhibit the effect of the invention both when used alone and when used in a composite with other fibers.

Other fibers to be composited therewith may be long fibers or short fibers, and there may be mentioned conventional publicly known fiber types including natural fibers such as cotton, hemp, wool, silk and the like, or synthetic fibers including cellulose-based fibers such as cupra, viscose, polynosic fiber and purified cellulose fiber, acetate, polyesters such as PET and PTT, nylon, acrylic and the like.

The compositing means used may be yarn blending by conventional publicly known cross-twisting or fiber mixing (including methods by interlacing and the like), or machine compositing such as cross-knitting or cross-weaving. For example, false twisted yarn according to the invention may be used as a core yarn with the aforementioned natural fibers or cellulose-based fibers as the sheath yarn, or a cross-woven fabric may employ the aforementioned natural fibers or cellulose-based fibers as either the warp yarn or weft yarn and false twisted yarn according to the invention or composite yarn such as core yarn for the other direction. Cross-woven fabrics employing spun yarn (including yarn-dyed yarn) of natural fibers or cellulose-based fibers as the warp and false twisted yarn according to the invention (untwisted or twisted) or the aforementioned core yarn as the weft are particularly suitable for jeans, chinos, corduroy and shirt fabrics.

These cross-woven fabrics are characterized by being resistant to knee-portion slackened, being resistant to wrinkling and allowing easy removal of wrinkles which are produced. Jeans and the like employing conventional polyurethane elastic fiber undergo deterioration or core yarn breakage due to product cleaning steps such as chlorine bleaching and stone washing, or due to repeated washing, but woven fabrics employing false twisted yarn according to the invention are virtually free of such problems.

A method for production of false twisted yarn of polyester compounds fiber according to the invention will now be explained.

In the production method of the invention, the trimethylene terephthalate cyclic dimer content of the compounds fiber is preferably no greater than 2.5 wt %. Trimethylene terephthalate cyclic dimers sublimate from the composite fiber during false twisting, but if the content is too high, the sublimated cyclic dimers attach to and accumulate on the guides, and result in increased yarn breakage during false twisting. The effect of the trimethylene terephthalate cyclic dimer content on false twisting is particularly notable when the two polyester components are a combination of PTT. A lower trimethylene terephthalate cyclic dimer content in the composite fiber is preferred, with a limit of 2.2 wt % being more preferred and 2.0 wt % being even more preferred.

Dyeing trouble is one of the problems that occurs with an excess trimethylene terephthalate cyclic dimer content. For example, when carrying out cheese dyeing, the trimethylene terephthalate cyclic dimers which have eluted into the dyeing solution adhere to the false twisted yarn during the dyeing, thus inhibiting circulation of the dyeing solution and resulting in uneven dyeing.

In order to reduce the trimethylene terephthalate cyclic dimer content in the composite fiber to within the preferred range, the PTT used for production of the composite fiber preferably has a trimethylene terephthalate cyclic dimer content of no greater than 2.5 wt %, and this can also be achieved by controlling the melt spinning conditions of the composite fiber or by adding a trimethylene terephthalate cyclic dimer reducer during the PTT polymerization or melt spinning of the composite fiber. Such means may, of course, also be combined.

Control of the melt spinning conditions for the composite fiber can be achieved by controlling the melt spinning temperature or residence time. For example, the melt spinning temperature is preferably 240–280° C. and more preferably 250–270° C., while the melt time is preferably within 20 minutes and more preferably within 15 minutes. The melt time is preferably as short as possible, but approximately 5 minutes is the lower limit for industrial operation.

The present inventors have found that the amount of trimethylene terephthalate cyclic dimers in the PTT increases during melt spinning, and have further found that specifying the range for the melt spinning conditions allows this increase in cyclic dimer content to be controlled.

When both of the polyester components are PTT, the trimethylene terephthalate cyclic dimer content in the composite fiber can be limited to no greater than 2.5% by a melt spinning temperature of 250–265° C. and a melt time of within 15 minutes. As a result, the trimethylene terephthalate cyclic dimer content of the false twisted yarn obtained by false twisting of the composite fiber will be no greater than 2.5%.

The difference in intrinsic viscosity between the two polyester components used for production of the composite fiber is 0.1–0.8 (dl/g). A difference in intrinsic viscosity within this range results in minimal yarn bending during spinning and permits stable spinning. When both of the two polyester components are PTT, the difference in intrinsic viscosity is preferably 0.1–0.4 dl/g and more preferably 0.15–0.35 dl/g.

Composite spinning equipment with a publicly known twin-screw extruder may be used for production of the composite fibers, in addition to employing the spinneret and drawing conditions described below.

An example of a spinneret is shown in FIG. 4. In FIG. 4, (a) is a distributing board and (b) is a spinneret. Two different PTT with different intrinsic viscosities are supplied from A and B, respectively, of the distributing board (a) to the spinneret (b). At the spinneret (b), they are combined and discharged from a discharge port at an inclination angle of θ° with respect to the vertical direction. The diameter of the discharge port is indicated by D and its length by L.

According to the invention, the ratio of the discharge port diameter D and length L (L/D) is preferably at least 2. An L/D ratio of at least 2 will result in stabilization of the adhesion after the two polyesters with different compositions or intrinsic viscosities are combined, thus giving fiber with a uniform size without variation due to melt viscosity difference. A higher L/D ratio is preferred, but from the standpoint of port fabrication technology, it is preferably 2–8 and more preferably 2.5–5.

The discharge port of the spinneret used for the invention must have an inclination angle of 10–40° with respect to the vertical direction. The inclination angle of the discharge port with respect to the vertical direction is shown by angle θ(°) in FIG. 4. The inclination of the port with respect to the vertical direction is an essential requirement for controlling yarn bending due to melt viscosity difference when the two polyesters with different compositions or intrinsic viscosities are discharged. If the inclination angle is 10–40°, stabilized spinning can be achieved with no bending phenomenon even when there is a large difference in intrinsic viscosity between the combination of PTT polymers used. The bending phenomenon is the phenomenon whereby the freshly discharged filaments bend in the direction of high intrinsic viscosity.

For example, when the difference in intrinsic viscosities of the PTT polymers is about 0.1 or greater, the discharge port must be inclined at an angle of at least 10° with respect to the vertical direction in order to achieve stable spinning with no bending phenomenon. When a difference in intrinsic viscosity is larger, the inclination angle is preferably larger.

According to the invention, preferably, the polyester component with high intrinsic viscosity is supplied on side A and the polyester component with low intrinsic viscosity on side B for discharge using the spinneret shown in FIG. 4.

According to the production method of the invention, the yarn temperature during false twisting is 140–190° C. and preferably 150–160° C. A yarn temperature within this range during false twisting results in false twisted yarn with excellent crimpability and low sublimation of trimethylene terephthalate cyclic dimers, so that yarn breakage during false twisting is minimal. Particularly when the two polyester components are both PTT, the yarn temperature during false twisting is preferably no higher than 165° C. in order to maintain stability of the false twisting.

The present inventors have been the first to discover that when the yarn temperature exceeds 190° C., the amount of trimethylene terephthalate cyclic dimers that sublimate from the composite fiber increases and yarn breakage during false twisting also increases, and have established the yarn temperature during false twisting according to the invention on the basis of this discovery. As compared to disclosure in the prior art such as WO00/47570 that the false twisting temperature for simple fibers composed only of PTT is 130–200° C., the yarn temperature for false twisting according to the invention is a strictly specified temperature which allows the special notable effect of the invention to be exhibited.

According to the invention there are no particular restrictions on the false twisting method, and it may be any type such as a pin type, friction type, nip-belt type or air false-twisting type method.

The heater may be a contact heater or a non-contact heater.

The twist number (T1) is preferably a number such that the twist number coefficient K1 value as calculated by the equation given below is preferably 21,000–33,000, and more preferably 25,000–32,000. A twist number coefficient K1 value within this range will give false twisted yarn with excellent crimpability and stretchability, with minimal yarn breakage during false twisting.

$$T1\ (\text{turns}/m)=K1/\{\text{composite fiber size (dtex)}\}^{1/2}$$

According to the invention, false twisting is preferably performed using composite fiber selected from any of the following (a), (b) or (c).

(a) Composite fiber wound into a pirn shape, having a breaking elongation of 25–50% and preferably 30–45%, and a dry heat shrinkage extreme stress of 0.10–0.30 cN/dtex and preferably 0.15–0.24 cN/dtex.

When the breaking elongation is within the above-mentioned range, yarn breakage during false twisting is minimal and the U % of the obtained textured yarn is small, resulting in less dyeing uneveness. When the dry heat shrinkage extreme stress is within the above-mentioned range, false twisted yarn with satisfactory stretching elongation can be easily produced.

(b) Composite fiber wound into a cheese shape, having a breaking elongation of 30–80% and preferably 45–70%, and a dry heat shrinkage extreme stress of 0–0.20 cN/dtex and preferably 0.03–0.15 cN/dtex.

When the breaking elongation is within the above-mentioned range, yarn breakage during false twisting is minimal and the U % of the obtained textured yarn is small, resulting in less dyeing uneveness. When the dry heat shrinkage extreme stress is within the above-mentioned range, production is facilitated and a package with a satisfactory wound shape is obtained.

(c) Undrawn composite fiber wound into a cheese shape, having a breaking elongation of 50–120%, a dry heat shrinkage extreme stress of 0–0.15 cN/dtex and preferably 0.01–0.10 cN/dtex, and a boiling water shrinkage of 1–10%.

When the breaking elongation is within the above-mentioned range, yarn breakage during false twisting is minimal and production is thus facilitated. When the dry heat shrinkage extreme stress is within the above-mentioned range, production is facilitated and a satisfactory wound shape is obtained. When the boiling water shrinkage is within the above-mentioned range, production is facilitated and the package shape does not deform even during storage at high temperature.

According to the invention, a double heater false twisting method is preferred, and the overfeed ratio in the double heater is preferably −10 to +5% and more preferably −7% to +3%. An overfeed ratio within this range will result in an untwisting torque of 100 turns/m or less, giving knitted fabrics with excellent surface quality and allowing smooth false twisting with stable conveying in the double heater.

A method for production of composite fiber used in false twisted yarn according to the invention will now be explained with reference to FIGS. 5, 6 and 7.

FIG. 5 is a schematic view of an example of a spinning apparatus for composite fiber wound in a pirn shape according to the invention.

Polymer pellets of one of the two polyester components are dried to a moisture content of 20 ppm or less with a drier 1, and then supplied to an extruder 2 set to a temperature of 250–290° C. for melting. The other component is also melted with a drier 3 and extruder 4 in the same manner.

The two melted polyesters are respectively fed through a bend 5 and a bend 6, to a spin head 7 set to 250–290° C., and dispensed separately with a gear pump. The two components are then combined with a spinneret 9 having a plurality of ports, mounted on a spin pack 8, and after being adhered in a side-by-side manner, they are discharged into a spinning chamber as yarn 10.

The yarn 10 discharged from the spinneret passes through a blow-free zone 11 provided directly under the spinneret, and is then cooled to room temperature by cooling air 12 for hardening, taken up by take-up godet rollers 13, 14 rotating at a prescribed speed, and wound up as an undrawn yarn package 15 of the prescribed yarn size.

The blow-free zone 11 is preferably 100–250 mm. Provision of the blow-free zone controls pre-orienting of the polyester component with high intrinsic viscosity, in order to obtain high-strength yarn. If the blow-free zone is in the aforementioned range, the pre-orienting will be appropriately controlled resulting in little yarn swaying and a uniform yarn size.

The undrawn yarn 15 is coated with a finishing agent by a finishing agent-coating apparatus 16 before contacting the take-up godet roller 13. The finishing agent used is preferably an aqueous emulsion type, at a concentration of preferably 15 wt % or greater and more preferably 20–35 wt %.

The wind-up speed for production of the undrawn yarn is preferably no greater than 2000 m/min, more preferably 1000–2000 m/min and more preferably 1200–1800 m/min.

The undrawn yarn is then supplied to a drawing step and drawn with a drawing machine, an example of which is shown in FIG. 6. For storage up until supply to the drawing step, the storage environment for the undrawn yarn is preferably an atmospheric temperature of 10–25° C. and a relative humidity of 75–100%. The undrawn fiber on the drawing machine is preferably kept at this temperature and humidity throughout the drawing.

On the drawing machine, first the undrawn yarn 15 is heated on a feed roller 17 set to 45–65° C., and the peripheral speed ratio between the feed roller 17 and drawing roller 20 is utilized for drawing to the prescribed size. After or during the drawing, the fiber is conveyed while contacting with a hot plate 19 set to 100–150° C., for tension heat treatment. The fiber which has left the drawing roller is twisted with a spindle and then wound up as a drawn yarn pirn 22.

The feed roller temperature is more preferably 50–60° C. and even more preferably 52–58° C.

If necessary, a drawing pin 18 may be provided for drawing between the feed roller 17 and hot plate 19. In such cases, the drawing roller temperature is preferably strictly controlled to preferably 50–60° C. and more preferably 52–58° C.

The drawn yarn leaving the drawing roller 20 is wound up as a drawn yarn pirn 22 while forming a balloon with a traveler guide 21.

The drawn composite fiber is preferably wound up in the pirn shape at a ballooning tension of 0.03–0.15 cN/dtex and more preferably 0.05–0.10 cN/dtex. If the ballooning tension is within this range, the pirn hardness will be about 80–90, crimpability will be stably maintained even after long-term storage, and the pirn shape will not experience load breakage during transport.

In order to impart twisting and/or interlacing to the composite fiber, for example, a drawing system such as shown in FIG. 6 may be used. The twisting and/or crossing can be set by the ratio of the speed of the drawing roller 20 and the rotation rate of the drawn yarn pirn 22. Interlacing may also be imparted by setting a publicly known interlacing apparatus under the drawing roll 20.

FIG. 7 shows an example of a spinning apparatus for composite fiber wound into a cheese shape according to the invention.

For production of a cheese package there may be employed a direct spinning/drawing method whereby spinning/drawing is carried out in a continuous manner, or a method in which undrawn yarn is wound up at high speed without drawing.

In a direct spinning/drawing method, the undrawn yarn is continuously drawn without first being wound up. If necessary, interlacing may be imparted with a interlacing apparatus 23 either before or after drawing. In a direct spinning/drawing method, the speed of the take-up godet roller 24 is preferably 1,000–3,000 m/min. The temperature of the take-up godet roller 24 is preferably 50–90° C. The temperature of the drawing godet roller 25 is preferably 100–160° C. The wind-up tension is preferably 0.03–0.15 cN/dtex.

For production of undrawn yarn at high speed by a wind-up method, the speed of the take-up godet roller 24 is preferably 2000–3000 m/min. The temperature of the take-up godet roller 24 is preferably 40–100° C. The temperature of the drawing godet roller 25 is also preferably 40–100° C. By heat treating the undrawn yarn at the take-up godet roller 24 or the drawing godet roller 25, it is possible to adjust the boiling water shrinkage of the undrawn yarn to 1–10%. The wind-up tension is preferably 0.03–0.15 cN/dtex.

The number of rollers is preferably either two or three pairs, depending on the need.

The yarn passing through the drawing godet roller 25 is wound up as a cheese package 26.

BRIEF DESCRIPTION OF THE DRAWINGS

In FIG. 1, X ($\times 10^{-3}$ cN/dtex) is the load applied to the false twisted yarn during boiling water treatment, and Y (%) on the vertical axis is the crimp factor of the false twisted yarn after boiling water treatment.

In FIG. 4, (a) is a distributing board, (b) is a spinneret, L is the port length, D is the discharge port diameter and θ is the discharge port inclination angle.

Figure 1:
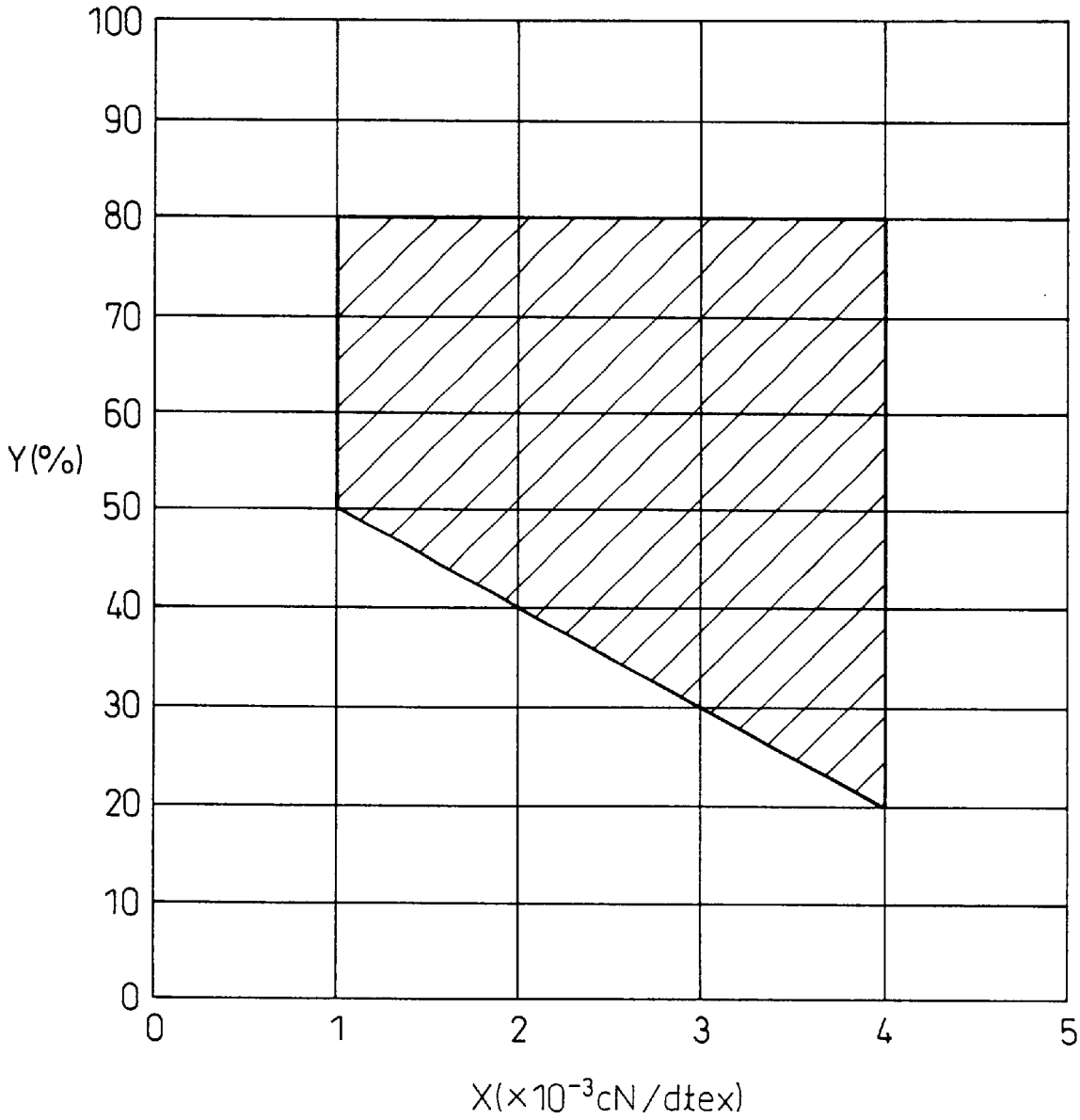
FIG. 1 is a graph showing the crimp development property of false twisted yarn according to the invention.
Figure 2A:
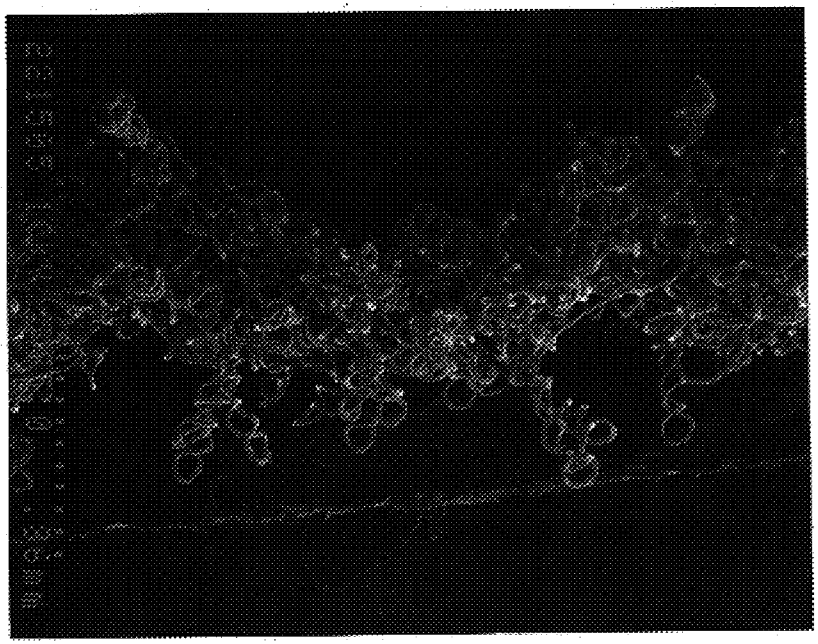
FIG. 2*a* is a scanning electron microscope photograph of the crimp form of the false twisted yarn obtained in Example 1 according to the invention after boiling water treatment in the absence of a load.
Figure 2B:
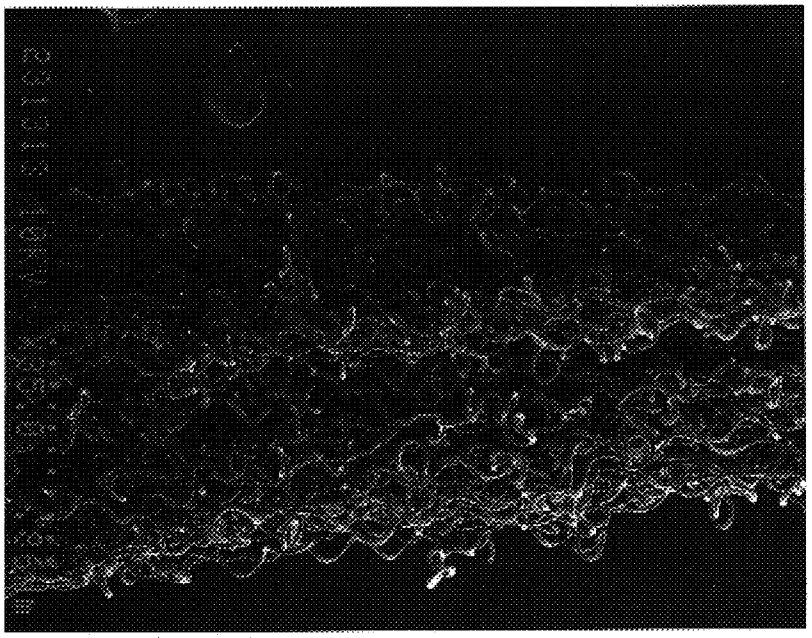
FIG. 2*b* is a scanning electron microscope photograph of the crimp form of the false twisted yarn obtained in Example 1 according to the invention after boiling water treatment under a load of $3\times10^{-3}$ cN/dtex.
Figure 3A:
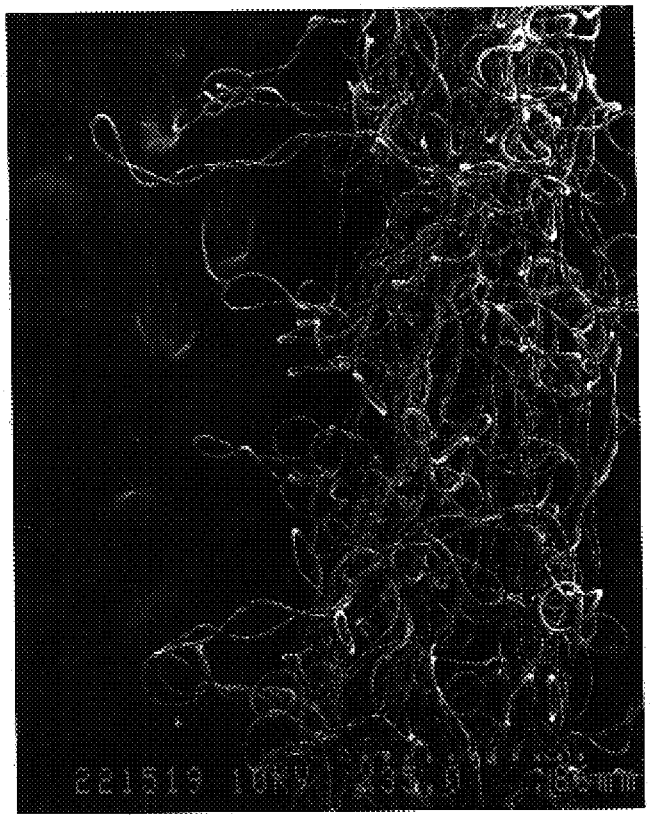
FIG. 3*a* is a scanning electron microscope photograph of the crimp form of false twisted yarn of simple fiber composed of PTT alone as in Comparative Example 7, after boiling water treatment in the absence of a load.
Figure 3B:
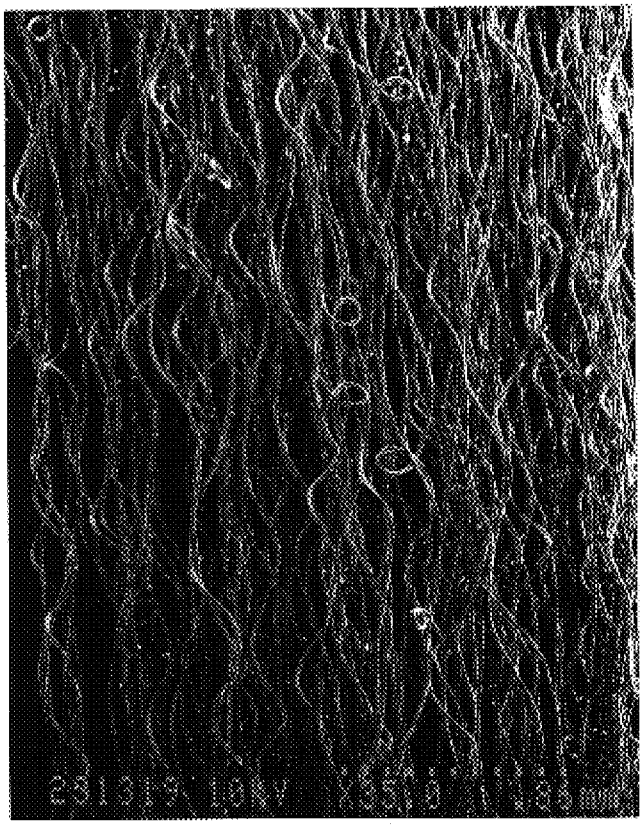
FIG. 3*b* is a scanning electron microscope photograph of the crimp form of false twisted yarn of simple fiber composed of PTT alone as in Comparative Example 7, after boiling water treatment under a load of $3\times10^{-3}$ cN/dtex.
Figure 4:
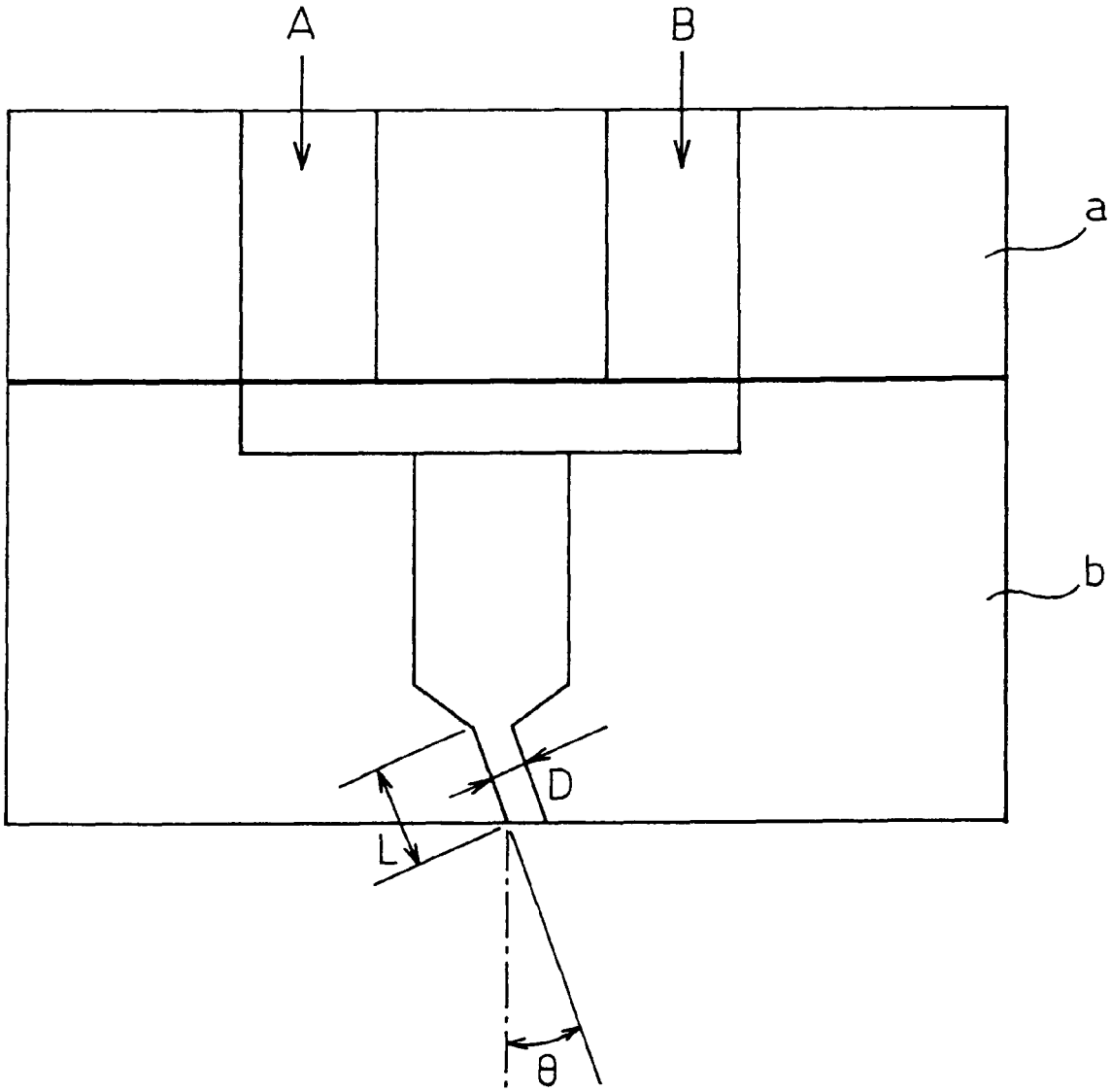
FIG. 4 is a schematic view of an example of the discharge port of a spinneret used for production according to the invention.
Figure 5:
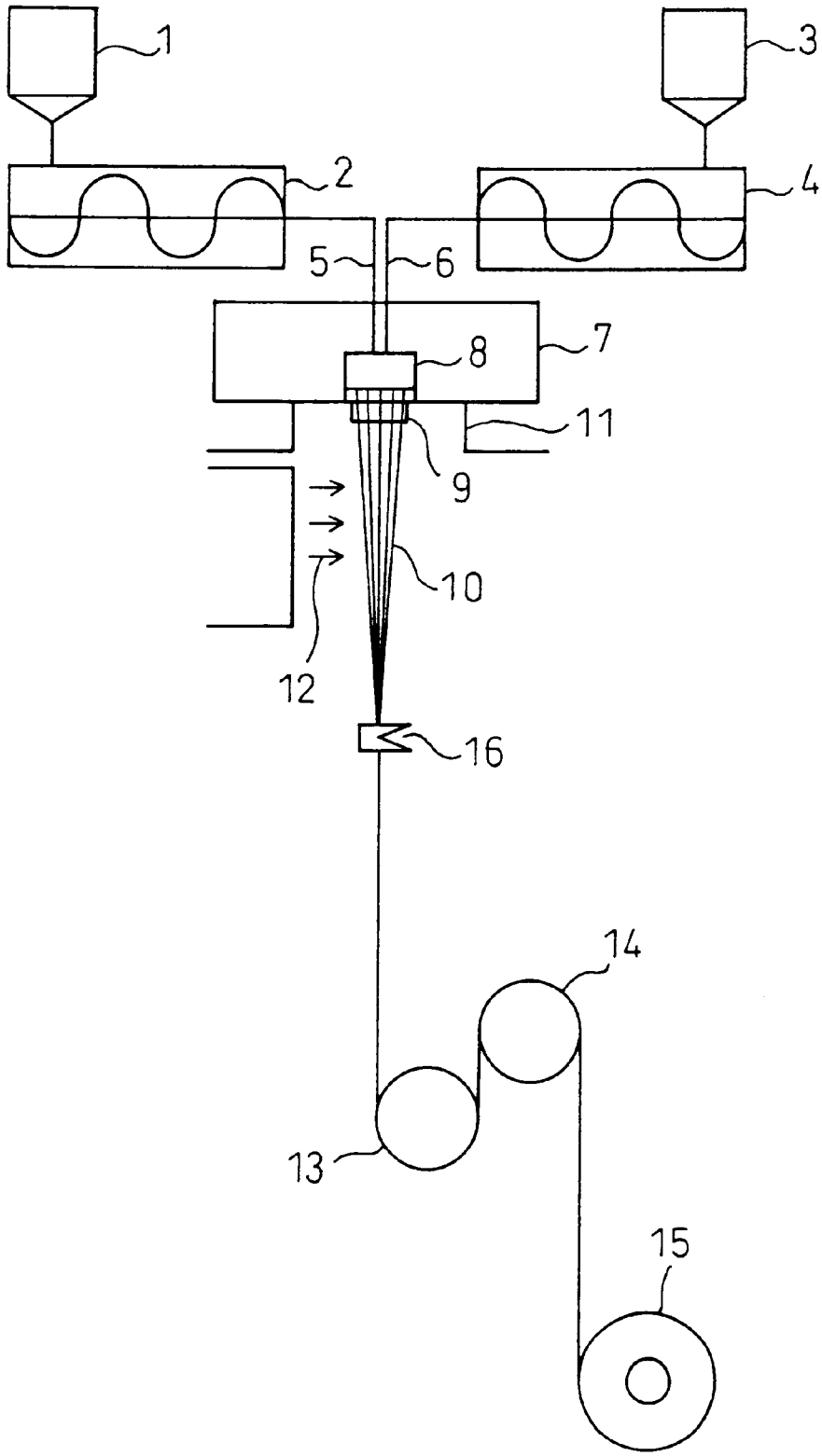
FIG. 5 is a schematic view of an example of a spinning apparatus used for production according to the invention.
Figure 6:
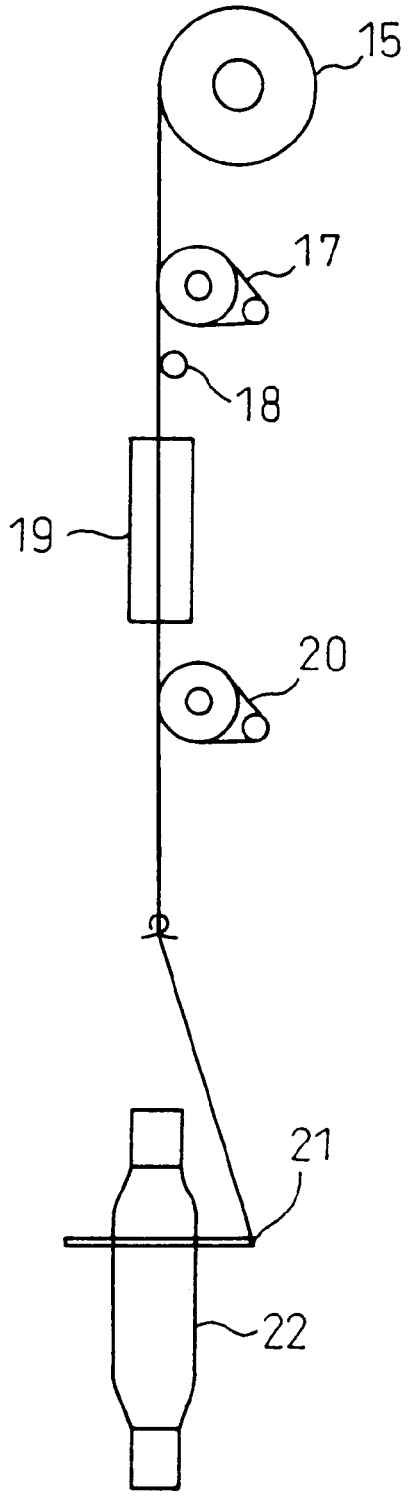
FIG. 6 is a schematic view of an example of a drawing machine used for production according to the invention.
Figure 7:
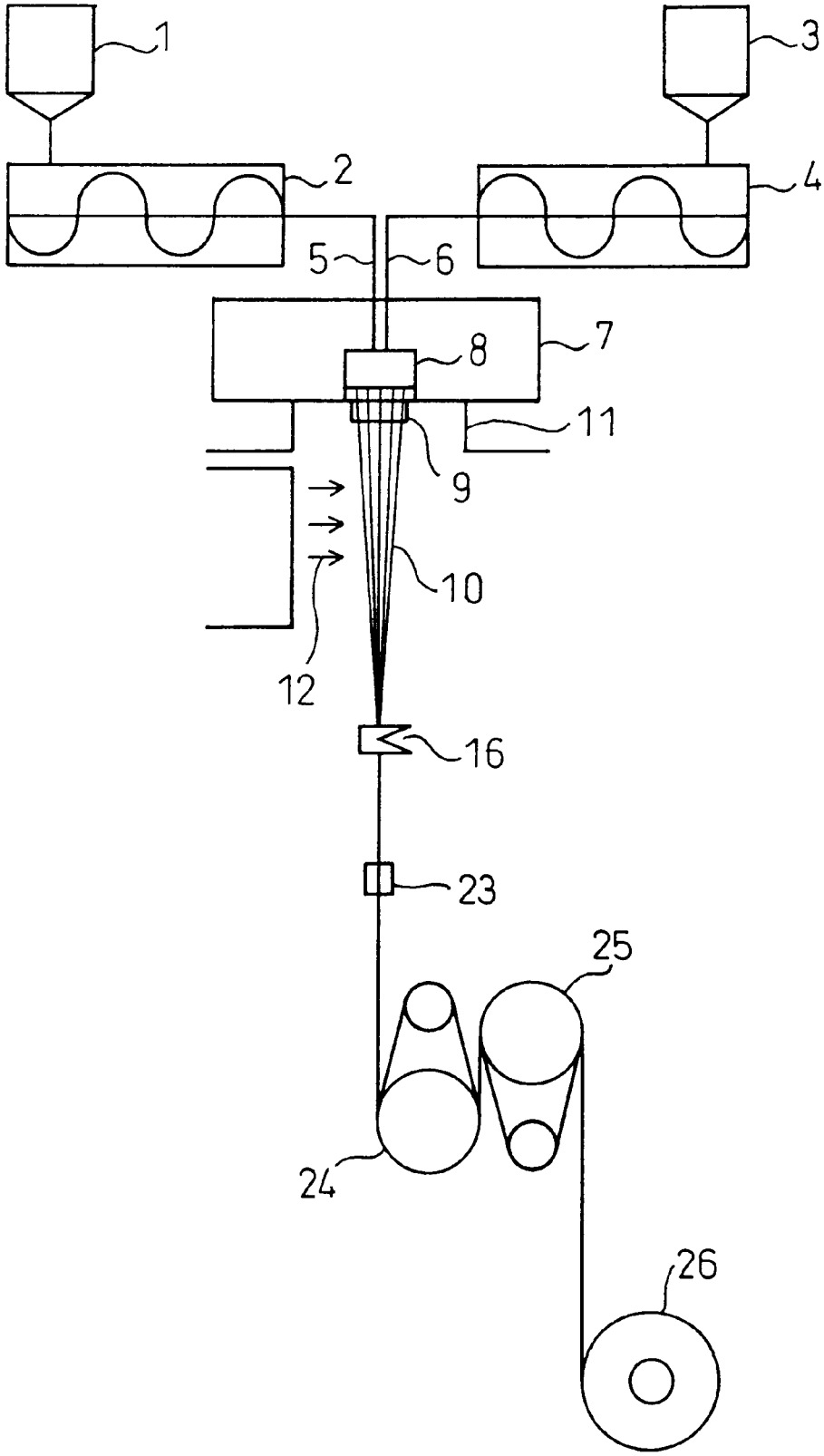
FIG. 7 is a schematic view of an example of a spinning/drawing apparatus used for production according to the invention.

The reference numerals in FIGS. 5, 6 and 7 represent the following.

1: polymer pellet drier, 2: extruder, 3: polymer pellet drier, 4: extruder, 5: bend, 6: bend, 7: spin head, 8: spin pack, 9: spinneret, 10: yarn, 11: blow-free zone, 12: cooling air, 13: take-up godet roller, 14: take-up godet roller, 15: undrawn yarn wound up into package, 16: finishing agent-coating apparatus, 17: feed roller, 18: drawing pin, 19: hot plate, 20: drawing roller, 21: traveler guide, 22: drawn yarn pirn, 23: interlacing apparatus, 24: take-up godet roller (1GD), 25: drawing godet roller (2GD), 26: drawn yarn or undrawn yarn package.

BEST MODE FOR CARRYING OUT THE INVENTION

The present invention will now be explained in greater detail by way of examples, with the understanding that the invention is in no way limited by the examples.

The measuring methods and evaluating methods were as follows.

(1) Intrinsic Viscosity

The intrinsic viscosity [η] (dl/g) is the value defined by the following formula.

$$[\varsigma] = \lim_{C\to 0}(\eta r - 1)/C$$

where ηr is the value of the viscosity of a diluted solution of the polyester polymer in an o-chlorophenol solvent at 98% purity or greater at 35° C., divided by the viscosity of the solvent measured at the same temperature, and it is defined as the relative viscosity. C is the polymer concentration expressed in g/100 ml.

Because it is impossible to separate the single filaments into the respective polymer components when measuring the intrinsic viscosity of the composite fiber, the average value was determined.

(2) Stretching Elongation of Developed Crimps

The yarn was reeled 10 times using a measuring device with a perimeter length of 1.125 m, and then allowed to stand a day and a night in a thermostatic chamber conforming to JIS-L1013 under no load.

Next, the load described below was applied to the hank, the hank length was measured and the stretching elongation of developed crimps was measured according to the following formula.

$$\text{Stretching elongation } (\%)=\{(L2-L1)/L1\}\times 100$$

L1 is the hank length under application of a load of $1\times10^{-3}$ cN/dtex, and L2 is the hank length under application of a load of 0.18 cN/dtex.

(3) Crimp Factor Under Load

The yarn was reeled 10 times using a measuring device with a perimeter length of 1.125 m, and then heat treated for 30 minutes in boiling water while being subjected to a load of $3\times10^{-3}$ cN/dtex. This was followed by dry heat treatment for 15 minutes at 180° C. while under the same load. After the treatment, it was allowed to stand a day and a night in a thermostatic chamber conforming to JIS-L1013 under no load. The load described below was then applied to the hank, the hank length was measured and the crimp factor was measured according to the following formula.

$$\text{Crimp factor } (\%) \text{ under load of } 3\times10^{-3} \text{ cN/dtex}=\{(L4-L3)/L4\}\times 100$$

L3 is the hank length under application of a load of $1\times10^{-3}$ cN/dtex, and L4 is the hank length under application of a load of 0.18 cN/dtex.

(4) Elongation Recovery Speed

The yarn was reeled 10 times using a measuring device with a perimeter length of 1.125 m, and then heat treated for 30 minutes in boiling water under no load. The boiling water treated false twisted yarn was subjected to the following measurement according to JIS-L1013.

The boiling water treated false twisted yarn was allowed to stand a day and a night under no load.

Using a tensile tester, the false twisted yarn was stretched to a tension of 0.15 cN/dtex, and after halting the pull and holding it for 3 minutes, the yarn was cut with scissors directly above the lower grip point.

The shrinkage rate of the false twisted yarn cut with the scissors was determined by photography using a high-speed video camera (resolution: 1/1000 sec). A millimeter unit standard was placed at a 10 mm spacing from and fixed parallel to the false twisted yarn, the focus was set to the tip of the cut false twisted yarn segment, and the course of recovery of the segment tip was photographed. The high-speed video camera images were reproduced, and the displacement with respect to time (mm/msec) of the tip of the false twisted yarn segment was read off to determine the elongation recovery speed (m/sec).

(5) Trimethylene Terephthalate Cyclic Dimer Content

The trimethylene terephthalate cyclic dimer content was measured by $^1$H-NMR.

The measuring device and conditions were as follows.

Measuring device: FT-NMR DPX-400, Bruker Co.

Solvent: Deuterated trifluoroacetic acid

Sample concentration: 2.0 wt %

Measuring temperature: 25° C.

Chemical shift reference: Tetramethylsilane (TMS) as 0 ppm

Integration: 256 times

Waiting time: 3.0 seconds

Fiber which had been washed and then dried at room temperature for 24 hours was used as a sample, and each measuring sample was used for $^1$H-NMR spectral analysis.

The trimethylene terephthalate cyclic dimer benzene ring-derived signal was used to determine the trimethylene terephthalate cyclic dimer content based on the proportion of the integral time with respect to the benzene ring-derived signal of PTT and/or other polyester.

The measurement was carried out 3 times for each sample, and the average value was taken.

When one component was PTT and the other was a compound other than PTT, it was expressed as the cyclic dimer content of the PTT in the composite fiber (or false twisted yarn).

(6) Breaking Strength, Breaking Elongation

These were measured according to JIS-L1013

(7) Thermal Stress Value

This was measured using a KE-2 Thermal Stress Measuring Apparatus (product of Kanebo Engineering Co.).

A filament was cut out to a length of about 20 cm and the ends were linked to form a loop, which was mounted in the measuring apparatus. Measurement was conducted under conditions with an initial load of 0.05 cN/dtex and a temperature elevating rate of 100° C./min, and the thermal stress temperature change was recorded on a chart. The thermal stress results as a bell curve in the high temperature region, and therefore the temperature of the peak value was recorded as the extreme temperature while the stress at that temperature was recorded as the extreme stress.

The value read as the extreme stress (cN) was halved and divided by the size (dtex), and then the initial load was subtracted therefrom giving a value for the thermal stress.

Thermal stress value (cN/dtex)={read value (cN)}/{size (dtex)×2}−initial load (cN/dtex)

(8) Yarn Temperature

The yarn temperature during false twisting was measured with a non-contact thermometer.

The measuring device used was a Model JTG-6200 Thermoviewer (product of JEOL Co., Ltd.).

(9) False Twisting Property

The condition of yarn breakage upon false twisting with a 144 weight for 48 hours under the following conditions was evaluated.

(False Twisting Conditions)

False twisting machine: IVF338 by Ishikawa Laboratory Co., Ltd.

False twisting turns: 3200 T/m

First heater temperature: Given in examples

False twisting speed: 150 m/min

The false twisting property was evaluated based on the following scale after counting the number of yarn breaks.

◎: Less than 10 yarn breaks

○: 11–20 yarn breaks

X: 21 or more yarn breaks

(10) Dyeability

The composite fiber was subjected to twisting at 120 T/m with an Italy Yarn Twister, after which a Soft Winder by Kamitsu Seisakusho, Ltd. was used to wind it up onto a paper tube with a diameter of 81 mm, at a winding density of 0.25 g/cm$^3$. The cheese was replaced with a dyeing tube with an outer diameter of 69 mm, and dyeing was carried out with a cheese dyeing machine (Small cheese dyeing machine, product of Hisaka Works, Ltd.).

(Dyeing Conditions)

Dye: Disperse dye (Dianix Blue AC-E), 1% owf

Dispersing agent: Disper TL, 0.5 g/l pH: 5.0 (adjusted with acetic acid)

Flow volume: 40 liters/min (In/out circulation of dye solution)

Temperature, time: 120° C., 30 minutes (Reduction Cleaning Conditions)

Hydrosulfite: 1 g/liter

Sunmorl RC-700 (Nicca Chemical Co., Ltd.): 1 g/liter

Sodium hydroxide: 1 g/liter

Flow volume: 40 liters/min

Temperature, time: 80° C., 30 minutes

The dyeability was evaluated in the following manner.

Using a weft knitting machine (14 gauge, product of Koppo Co.), the cheese dyed false twisted yarn was weft knitted into a 24-course, 20-wale plain knitting texture and then subjected to steam finishing with a Hoffman press (Kobe Press, product of Kobe Electrical Engineering Co., Ltd.) to prepare a weft knitted fabric. Dyeing uneveness in the weft knitted fabric were evaluated by 3 skilled professionals and judged on the following scale.

◎: No uneveness or other defects, very satisfactory

○: No uneveness or other defects, satisfactory

X: Uneveness, unsatisfactory

(11) Fabric Stretchability and Elongation Recovery

Fabric was fabricated in the following manner.

Plain weave fabrics were prepared with a warp density of 97/2.54 cm and a weft density of 88/2.54 cm using untwisted sized yarn of 84 dtex/24 f PTT simple fiber ("Solo", trademark of Asahi Chemical, KK.) as the warp yarn and 84 dtex/24 f false twisted yarn obtained in the examples of the invention and the comparative examples as the weft yarn.

Weaving machine: ZW-303 Water Jet Loom (product of Tsudakoma Corp.)

Weaving speed: 450 revolutions/min

The obtained grey fabric was subjected to relax scouring at 95° C. in a liquid relaxer and then dyed at 120° C. in a jet dyeing machine. It was then finished and tentered at 170° C. and subjected to a series of thermal setting treatments. The finished fabric had a warp density of 160/2.54 cm and a weft density of 93/2.54 cm.

The obtained fabric was used to evaluate the stretchability and elongation recovery by the following method.

A sample was stretched in the weft direction using a tensile tester by Shimadzu Corporation with a grip width of 2 cm, a grip spacing of 10 cm and a pull rate of 10 cm/min, and the elongation (%) under a stress of 2.94 N/cm was recorded as the stretchability.

After then allowing it to shrink back to the grip spacing of 10 cm at the same speed, a stress/strain curve was drawn and the elongation up to the same stress was recorded as the residual elongation (A). The elongation recovery was calculated by the following formula.

$$\text{Elongation recovery (\%)}=[(10-A)/10]\times 100$$

(12) Knitted Fabric Surface Quality

The false twisted yarn was double wound to a total size of 168 dtex, and a tubular knitted fabric was prepared using a circular knitting machine by Tohei Machinery Co. (22 gauge/2.54 cm). The tubular knitted fabric was treated in boiling water at 100° C. for 30 minutes with no load and then dried, and the surface quality was evaluated by 5 panelists based on the following scale.

⊙: Satisfactory surface quality

○: Somewhat satisfactory surface quality

X: Unsatisfactory surface quality (irregularities)

Examples 1–4, Comparative Example 1

These examples illustrate the effects of stretching elongation of developed crimps and the crimp factor under load.

(Production of Stock Yarn for False Twisting)

In these examples, pirn-wound yarn was used as the stock yarn for false twisting.

In producing the stock yarn for false twisting, PTT was used for both the high viscosity component and low viscosity component, with different intrinsic viscosities for each PTT and different trimethylene terephthalate cyclic dimer contents in the PTT as shown in Table 1a, to produce side-by-side composite fibers. The blending ratio of the high viscosity component and low viscosity component was 50/50.

The composite fiber production conditions were as follows.

(Spinneret)

Diameter: 0.50 mm

Discharge port diameter/length ratio: 2.0

Inclination angle of port with respect to vertical direction: 35° (0° for single component)

Number of ports: 24

(Spinning Conditions)

Pellet drying temperature and final moisture content: 110° C., 15 ppm

Extruder temperature: 250° C.

Spin head temperature: 265° C.

Melt time: 12 minutes

Polymer discharge volume: Conditions set for a drawn yarn size of 84 dtex

Blow-free zone: 125 mm

Cooling air conditions: Temperature=22° C., relative humidity=90%, speed=0.5 m/sec Finishing agent: Aqueous emulsion composed mainly of polyetherester (concentration: 20 wt %)

Take-up speed: 1100 m/min (Undrawn Yarn)

Size: Set for drawn size of 84 dtex

Moisture content: 0.5 wt %

Storage temperature: 22° C.

(Drawing Conditions)

Drawing speed: 800 m/min

Spindle rotation rate: 8000 rpm

Drawing roll temperature: 55° C.

Hot plate temperature: 130° C.

Ballooning tension: 0.07 cN/dtex (Drawn Yarn Pirn)

Size/no. of filaments: 84 dtex/24 f

Wound weight: 2.5 kg

No. of twists: 10/m

No. of crossings: 20/m

Pirn hardness: 84

(False Twisting Conditions)

False twisting machine: IVF338 by Ishikawa Laboratory Co., Ltd.

False twisting turns: 3200 T/m

First heater temperature: 160° C.

False twisting speed: 150 m/min

The properties of the obtained composite fibers are shown in Table 1a , and the properties of the false twisted yarn are shown in Table 1b.

As seen from Table 1b, the false twisted yarn of the invention had a high crimp development property and also satisfactory dyeing uniformity. The woven fabrics also exhibited excellent stretchability and elongation recovery.

The false twisted yarn of Comparative Example 1 had low stretching elongation of crimps while the trimethylene terephthalate cyclic dimer content was also high, resulting in an unsatisfactory false twisting property.

The false twisted yarn obtained in Example 1 was then used as the warp and weft yarn without twisting to obtain a grey plain weave fabric with a warp density of 95/2.54 cm and a weft density of 80/2.54 cm. The grey fabric was dyed to obtain a woven fabric with a warp density of 150/2.54 cm and a weft density of 125/2.54 cm.

The obtained woven fabric had a smooth surface, a stretchability of 42% in the warp direction, an elongation recovery of 85% and a stress of 98 cN/cm at 20% elongation, thus exhibiting satisfactory surface quality and dyed quality and excellent stretchability even when used as warp yarn.

The false twisted yarn of Examples 1–4 all had minimum differential Young moduli of 15 cN/dtex or lower at 3–10% elongation, and the fabrics also exhibited a soft feel.

The crystallinity as measured by the density method was high at 35–50%, and no crimp flow was produced even by heating during the processing steps such as knitting or sewing, resulting in fabrics with excellent crimp fastness.

Low temperature dyeability was also exhibited as a characteristic for dyeing at 120° C. or below.

Examples 5–7, Comparative Examples 2 and 3

These examples illustrate the effect of the trimethylene terephthalate cyclic dimer content in the false twisted yarn.

During production of the side-by-side composite fiber of Example 1, PTT with a different trimethylene terephthalate cyclic dimer content was used as the low viscosity component to obtain the composite fiber.

The composite fiber was false twisted in the same manner as Example 1. The false twisting properties are shown in Table 2.

As seen from Table 2, the false twisted yarn of the invention had satisfactory texturability as well as satisfactory dyeing uniformity.

Comparative Examples 2 and 3 had trimethylene terephthalate cyclic dimer contents outside of the scope of the invention, and exhibited inferior false twisting properties and dyeing uniformity.

Examples 8–11 and Comparative Examples 4–5

These examples illustrate the effect of the yarn temperature during false twisting.

The yarn temperature during false twisting was altered as shown in Table 3 for the false twisting of Example 1. The false twisting properties and textured yarn properties are shown in Table 3.

As seen from Table 3, false twisting conditions within the scope of the invention resulted in satisfactory texturability, and the false twisted yarn exhibited excellent crimpability, elongation recovery and dyeing uniformity.

Examples 12–17

These examples illustrate the effect of using package-wound composite drawn fiber or composite undrawn fiber as the composite fiber supplied for false twisting.

(Production of Drawn Composite Fiber and Undrawn Composite Fiber)

The spinning/drawing/winding machine shown in FIG. 7 was used for production. The spinning conditions were the same as in Example 1, and the winding conditions were as follows.

(Winding Conditions for Drawn Composite Fibers)

First godet roller speed: 2000 m/min

First godet roller temperature: 55° C.

Second godet roller temperature: 120° C.

The second godet roller speed was varied to obtain composite drawn fibers with the breaking strengths shown in Table 4a.

(Winding Conditions for Undrawn Composite Fibers)

First godet roller temperature: 60° C.

Second godet roller temperature: 120° C.

The first godet roller speed was varied to 2500, 2300 and 2000 m/min and the second godet roller speed was set to approximately the same speed as the first godet roller speed for winding, to obtain composite undrawn fibers with breaking strengths of 71%, 80% and 100%.

The false twisting for these examples was carried out in the following manner.

False twisting machine: 33H False Twisting Machine by Murata Machinery Laboratory Co.

False twisting conditions:

Yarn speed: 300 m/min

False twisting turns: 3230 T/m

Drawing ratio: Set for a textured yarn elongation of 35%

First feed rate: −1%

First heater temperature: 165° C.

Second feed rate: −3%

The properties of the composite fibers are shown in Table 4a and the properties of the false twisted yarn are shown in Table 4b.

As seen from Table 4b, the false twisted yarn obtained by twisting the package-wound composite fibers according to the invention exhibited excellent crimp development, elongation recovery and dye uniformity.

Examples 18 and 19, Comparative Example 6

These examples illustrate the effect of the type of the polymers used for the high viscosity component and low viscosity component.

High viscosity components and low viscosity components were used in the combinations shown in Table 5a to obtain side-by-side composite fibers according to Example 1.

For Example 20, Comparative Example 6 and Comparative Example 7, the melt temperature was 280° C. False twisting was performed in the same manner as Example 1, and the properties of the obtain false twisted yarn are shown in Table 5b.

As seen from Table 5b, the false twisted yarn of the invention exhibited excellent crimp development, elongation recovery and dye uniformity.

Comparative Example 6 which used PET as both components had inferior crimpability and elongation recovery.

Comparative Example 7

This comparative example illustrates false twisted yarn of PTT simple fiber.

False twisting was performed in the same manner as Example 1 except that 84 T/24 f fiber ("Solo", trademark of Asahi Chemical, KK.) was used as the simple fiber composed of PTT alone, and the yarn temperature during false twisting was 190° C.

The false twisted yarn had an untwisting torque of 167 turns/m. This false twisted yarn was used to prepare a woven fabric in the same manner as Example 1. The properties of the false twisted yarn and woven fabric are shown in Table 5b. The stress of the fabric at 20% elongation was 294 cN/cm.

Examples 20–23, Comparative Example 8

These examples illustrate the effect of double heater set yarn.

The composite fiber obtained in Example 1 was used as the composite fiber for false twisting, and double-heater false twisting was carried out under the following conditions. False twisting machine: 33H False Twisting Machine by Murata Machinery Laboratory Co. False twisting conditions:

Yarn speed: 300 m/min

False twisting turns: 3230 T/m

Drawing ratio: factor of 1.08

First heater temperature: 165° C.

First feed rate: −1%

Second heater temperature: 150° C.

The overfeed ratio in the second heater zone was varied as shown in Table 6. The properties of the obtained false twisted yarn are also shown in Table 6.

As will be clearly understood from these examples, an overfeed ratio within the scope of the invention resulted in stable false twisted yarn texturing, and produced false twisted yarn with satisfactory stretchability and free-movement properties, as well as excellent dye uniformity.

The results of the examples and comparative examples described above are summarized in Tables 1a to 6.

TABLE 1a

| | High viscosity component | | Low viscosity component | | Intrinsic | Composite fiber | D content of | | | |
|---|---|---|---|---|---|---|---|---|---|---|
| | Intrinsic viscosity (dl/g) | D content (wt %) | Intrinsic viscosity (dl/g) | D content (wt %) | viscosity difference (dl/g) | intrinsic viscosity (dl/g) | composite fiber PTT (wt %) | Breaking strength (cN/dtex) | Breaking elongation (%) | Thermal stress (cN/dtex) |
| Example 1 | 1.26 | 0.8 | 0.91 | 1.1 | 0.35 | 0.94 | 1.9 | 2.8 | 38 | 0.24 |
| Example 2 | 1.22 | 0.9 | 0.91 | 1.1 | 0.31 | 0.91 | 2.0 | 2.5 | 36 | 0.22 |
| Example 3 | 1.15 | 0.9 | 0.91 | 1.1 | 0.24 | 0.89 | 2.1 | 2.5 | 35 | 0.21 |
| Example 4 | 1.10 | 1.0 | 0.91 | 1.1 | 0.19 | 0.80 | 2.4 | 2.5 | 36 | 0.22 |
| Comp. Ex. 1 | 0.95 | 1.1 | 0.91 | 1.1 | 0.04 | 0.77 | 2.6 | 2.8 | 40 | 0.27 |

Note:
D content = trimethylene terephthalate cyclic dimer content

TABLE 1b

| | False twisting property | Stretching elongation of developed crimps (%) | Crimp factor under load (%) | Elongation recovery speed (m/sec) | D content of twisted yarn PTT (wt %) | Fiber size fluctuation value U % (%) | Breaking strength (cN/dtex) | Fabric dye-ability | Fabric stretch-ability (%) | Fabric elongation recovery (%) | Overall evaluation |
|---|---|---|---|---|---|---|---|---|---|---|---|
| Example 1 | ◎ | 92 | 52 | 30 | 2.0 | 1.1 | 2.5 | ◎ | 55 | 88 | ◎ |
| Example 2 | ◎ | 80 | 45 | 28 | 2.1 | 1.1 | 2.4 | ◎ | 50 | 85 | ◎ |
| Example 3 | ◎ | 62 | 36 | 25 | 2.2 | 1.0 | 2.4 | ◎ | 45 | 82 | ◎ |
| Example 4 | ○ | 55 | 30 | 22 | 2.3 | 0.9 | 2.5 | ○ | 40 | 80 | ○ |
| Comp. Ex. 1 | X | 40 | 16 | 18 | 2.6 | 1.0 | 2.6 | X | 24 | 75 | X |

Note:
D content = trimethylene terephthalate cyclic dimer content

TABLE 2

| | Low viscosity component | | D content of | | | |
|---|---|---|---|---|---|---|
| | Intrinsic viscosity (dl/g) | D content (wt %) | composite fiber PTT (wt %) | False twisting property | Fabric dye-ability | Overall evaluation |
| Example 5 | 0.92 | 0.9 | 2.0 | ◎ | ◎ | ◎ |
| Example 6 | 0.92 | 1.0 | 2.2 | ◎ | ◎ | ◎ |
| Example 7 | 0.92 | 1.3 | 2.4 | ○ | ○ | ○ |

TABLE 2-continued

| | Low viscosity component | | D content of | | | |
|---|---|---|---|---|---|---|
| | Intrinsic viscosity (dl/g) | D content (wt %) | composite fiber PTT (wt %) | False twisting property | Fabric dye-ability | Overall evaluation |
| Comp. Ex. 2 | 0.92 | 2.3 | 2.6 | X | X | X |
| Comp. Ex. 3 | 0.92 | 2.6 | 2.8 | X | X | X |

Note:
D content = trimethylene terephthalate cyclic dimer content

TABLE 3

| | False twisting yarn temperature (° C.) | False twisting property | Stretching elongation of developed crimps (%) | Crimp factor under load (%) | Elongation recovery speed (m/sec) | Breaking strength (cN/dtex) | Fabric dye-ability | Fabric stretch-ability (%) | Fabric elongation recovery (%) | Overall evaluation |
|---|---|---|---|---|---|---|---|---|---|---|
| Comp. Ex. 4 | 130 | ◎ | 45 | 20 | 19 | 2.5 | ◎ | 22 | 76 | X |
| Example 8 | 140 | ◎ | 53 | 31 | 24 | 2.6 | ◎ | 37 | 82 | ○ |
| Example 9 | 150 | ◎ | 88 | 36 | 27 | 2.5 | ◎ | 52 | 85 | ◎ |
| Example 10 | 165 | ◎ | 105 | 55 | 34 | 2.5 | ◎ | 57 | 88 | ◎ |
| Example 11 | 170 | ○ | 140 | 60 | 35 | 2.4 | ◎ | 60 | 90 | ○ |
| Comp. Ex. 5 | 195 | X | * | * | * | * | * | * | * | X |

* = Unmeasurable

TABLE 4A

| | Cheese package yarn type | Breaking strength (cN/dtex) | Breaking elongation (%) | Thermal stress (cN/dtex) | Shrinkage in boiling water (%) |
|---|---|---|---|---|---|
| Example 12 | Drawn yarn | 2.5 | 31 | 0.19 | 9 |
| Example 13 | | 2.2 | 48 | 0.07 | 7 |
| Example 14 | | 2.0 | 70 | 0.03 | 4 |

TABLE 4A-continued

| | Cheese package yarn type | Breaking strength (cN/dtex) | Breaking elongation (%) | Thermal stress (cN/dtex) | Shrinkage in boiling water (%) |
|---|---|---|---|---|---|
| Example 15 | Undrawn yarn | 1.9 | 71 | 0.03 | 7 |
| Example 16 | | 1.7 | 80 | 0.02 | 7 |
| Example 17 | | 1.5 | 100 | 0.02 | 6 |

TABLE 4b

| | False twisting property | Stretching elongation of developed crimps (%) | Crimp factor under load (%) | Elongation recovery speed (m/sec) | D content of twisted yarn PTT (wt %) | Fiber size fluctuation value U % (%) | Breaking strength (cN/dtex) | Fabric dye-ability | Fabric stretch-ability (%) | Fabric elongation recovery (%) | Overall evaluation |
|---|---|---|---|---|---|---|---|---|---|---|---|
| Example 12 | ○ | 260 | 64 | 34 | 1.9 | 0.8 | 2.8 | ◎ | 60 | 90 | ○ |
| Example 13 | ◎ | 232 | 58 | 30 | 1.9 | 0.9 | 2.4 | ◎ | 54 | 87 | ◎ |
| Example 14 | ◎ | 207 | 57 | 29 | 2.0 | 1.2 | 2.3 | ◎ | 50 | 85 | ◎ |
| Example 15 | ◎ | 220 | 56 | 29 | 1.9 | 1.0 | 2.3 | ◎ | 55 | 88 | ◎ |
| Example 16 | ◎ | 211 | 54 | 28 | 1.8 | 0.9 | 2.3 | ◎ | 51 | 85 | ◎ |
| Example 17 | ◎ | 203 | 49 | 25 | 1.8 | 1.0 | 2.3 | ◎ | 50 | 85 | ◎ |

Note:

D content = trimethylene terephthalate cyclic dimer content

TABLE 5a

| | High viscosity component | | | Low viscosity component | | | Intrinsic | Composite fiber | D content of | | | |
|---|---|---|---|---|---|---|---|---|---|---|---|---|
| | Polymer type | Intrinsic viscosity (dl/g) | D content (wt %) | Polymer type | Intrinsic viscosity (dl/g) | D content (wt %) | viscosity difference (dl/g) | intrinsic viscosity (dl/g) | composite fiber PTT (wt %) | Breaking strength (cN/dtex) | Breaking elongation (%) | Thermal stress (cN/dtex) |
| Example 18 | PTT | 1.26 | 0.8 | PBT | 1.00 | — | 0.26 | 0.96 | 1.7 | 3.0 | 35 | 0.30 |
| Example 19 | PTT | 1.28 | 0.8 | PET | 0.50 | — | 0.78 | 0.75 | 1.6 | 3.1 | 35 | 0.32 |
| Comp. Ex. 6 | PET | 0.72 | — | PET | 0.50 | — | 0.22 | 0.60 | — | 4.1 | 32 | 0.33 |

Note:

D content = trimethylene terephthalate cyclic dimer content

TABLE 5b

| | False twisting property | Stretching elongation of developed crimps (%) | Crimp factor under load (%) | Elongation recovery speed (m/sec) | D content of twisted yarn PTT (wt %) | Fiber size fluctuation value U % (%) | Breaking strength (cN/dtex) | Fabric dye-ability | Fabric stretch-ability (%) | Fabric elongation recovery (%) | Overall evaluation |
|---|---|---|---|---|---|---|---|---|---|---|---|
| Example 18 | ◎ | 72 | 38 | 22 | 1.7 | 1.1 | 2.7 | ◎ | 40 | 84 | ◎ |
| Example 19 | ○ | 52 | 31 | 20 | 1.6 | 1.3 | 2.9 | ○ | 31 | 80 | ○ |
| Comp. Ex. 6 | ◎ | 12 | 14 | 15 | — | 1.2 | 3.6 | ◎ | 5 | 65 | X |
| Comp. Ex. 7 | ◎ | 65 | 25 | 18 | 1.8 | 0.9 | 2.8 | ◎ | 20 | 75 | X |

Note:

D content = trimethylene terephthalate cyclic dimer content

TABLE 6

| | 2nd heater overfeed ratio (%) | False twisting property | Untwisting torque (turns/m) | Crimp factor under load (%) | Elongation recovery speed (m/sec) | Fiber size fluctuation value U % (%) | Breaking strength (cN/dtex) | Breaking elongation (%) | Fabric dye-ability | Fabric surface quality | Overall evaluation |
|---|---|---|---|---|---|---|---|---|---|---|---|
| Example 20 | −5 | ◎ | 73 | 38 | 29 | 1.0 | 2.6 | 33 | ◎ | ○ | ◎ |
| Example 21 | −3 | ◎ | 64 | 35 | 25 | 1.0 | 2.5 | 35 | ◎ | ◎ | ◎ |
| Example 22 | 0 | ◎ | 70 | 33 | 24 | 1.0 | 2.5 | 38 | ◎ | ◎ | ◎ |
| Example 23 | +4 | ◎ | 63 | 30 | 20 | 1.1 | 2.4 | 43 | ◎ | ◎ | ○ |
| Comp. Ex. 8 | +7 | ○ | 72 | 18 | 12 | 1.6 | 2.3 | 47 | ○ | ◎ | X |

Industrial Applicability

The false twisted yarn of polyester composite fiber according to the invention is not susceptible to dyeing trouble and exhibits high stretch properties and elongation recovery even when used in knitted or woven fabrics with high binding force, and therefore produces knitted fabrics with superior stretchability and rapid stretch recovery, or excellent free-movement properties.

The present invention also possesses high industrial value since it provides a method for industrially stable production of false twisted yarn of polyester composite fiber.

What is claimed is:

1. A false twisted yarn comprising a polyester composite fiber, said false twisted yarn having the following conditions:

the composite fiber of the yarn is composed of single filaments with two polyester components laminated in a side-by-side manner or core-sheath manner;

at least one of the components of the two polyester components composing the single filaments is poly (trimethylene terephthalate);

the difference in intrinsic viscosity between the two polyester components is 0.05–0.9 (dl/g);

the yarn has latent crimpability; and the yarn has at least 50% stretching elongation of developed crimps prior to a boiling water treatment.

2. The false twisted yarn of claim 1, wherein the mean intrinsic viscosity of the composite fiber is 0.6–1.2 (dl/g).

3. The false twisted yarn of claim 1 or 2, having the following conditions:

the yarn has 50 to 300% stretching elongation of developed crimps prior to a boiling water treatment;

a relationship between a load X ($\times 10^{-3}$ cN/dtex) during a boiling water treatment and a crimp factor Y(%) after a boiling water treatment satisfies the inequality $-10X+60 \leqq Y \leqq 80$, provided that $1 \leqq X \leqq 4$;

an elongation recovery speed of the false twisted yarn after a boiling water treatment is 15–50 m/sec; and a breaking elongation of the false twisted yarn before a boiling water treatment is 25% or greater.

4. The false twisted yarn of claim 1 or 2, wherein the poly(trimethylene terephthalate) is either a poly (trimethylene terephthalate) homopolymer or a copolymer containing no more than 10 mole percent of repeating ester units other than repeating trimethylene terephthalate units.

5. The false twisted yarn of claim 1 or 2, wherein the stretching elongation of developed crimps prior to the boiling water treatment is 70–300%.

6. The false twisted yarn of claim 1 or 2, wherein a crimp factor measured after a boiling water treatment with a load of $3\times10^{-3}$ cN/dtex is 35% or greater.

7. The false twisted yarn of claim 1 or 2, having the following conditions:

the poly(trimethylene terephthalate) is either a poly (trimethylene terephthalate) homopolymer or a copolymer containing no more than 10 mole percent of repeating ester units other than repeating trimethylene terephthalate units;

an untwisting torque is no greater than 100 turns/m;

a relationship between a load X ($\times 10^{-3}$ cN/dtex) during a boiling water treatment and a crimp factor Y(%) after a boiling water treatment satisfies the inequality $-10X+60 \leqq Y \leqq 80$, provided that $1 \leqq X \leqq 4$;

an elongation recovery speed of the false twisted yarn after a boiling water treatment is 15–50 m/sec; and a breaking elongation of the false twisted yarn before a boiling water treatment is 25% or greater.

8. The false twisted yarn of claim 7, wherein a crimp factor measured after a boiling water treatment with a load of $3\times10^{-3}$ cN/dtex 30% or greater.

9. The false twisted yarn of claim 1 or 2, wherein one of the polyester components is poly(ethylene terephthalate), poly(propylene terephthalate), or poly(butylene terephthalate).

10. The false twisted yarn of claim 1 or 2, wherein the poly(trimethylene terephthalate) contains no trifunctional components.

11. The false twisted yarn of claim 1 or 2, wherein a content of trimethylene terephthalate cyclic dimers in the false twisted yarn is no greater than 2.5 wt %.

12. The false twisted yarn of claim 1 or 2, wherein a fiber size fructuation value (U %) of the false twisted yarn is no greater than 1.5%.

13. A knitted or woven fabric made of the false twisted yarn of claim 1 or 2 for all or a portion thereof.

14. A method for producing a false twisted yarn of polyester composite fiber having the following conditions:

the composite fiber of the yarn is composed of single filaments with two polyester components laminated in a side-by-side manner or core-sheath manner;

the difference in intrinsic viscosity between the two polyester components is 0.1–0.8 (dl/g);

at least one of the components of the two polyester components is poly(trimethylene terephthalate); and a content of trimethylene terephthalate cyclic dimers in the false twisted yarn is no greater than 2.5 wt %, comprising discharging the polyester components from a spinneret having a discharge port inclined at an angle of 10–40° with respect to a vertical direction and then, after cooling to solidification, taking up the discharged polyester components either with or without drawing to obtain a polyester composite fiber and false twisting the polyester composite fiber at a temperature of 140 to 190° C.

15. The method of claim 14, wherein the polyester composite fiber is false twisted by a double heater method, and an overfeed ratio in a second heater is −10 to +5%.

16. The method of claim 14 or 15, wherein both of the two polyester components are poly(trimethylene terephthalate), the poly(trimethylene terephthalate) contains no trifunctional components, a mean intrinsic viscosity of the composite fiber is 0.6–1.2 (dl/g), and the false twisting is performed using a composite fiber selected from among the following (a) to (c):

(a) a composite fiber wound into a pirn shape, having a breaking elongation of 25–50% and a dry heat shrinkage extreme stress of 0.10–0.30 cN/dtex;

(b) a composite fiber wound into a cheese shape, having a breaking elongation of 30–80% and a dry heat shrinkage extreme stress of 0–0.20 cN/dtex; and (c) an undrawn composite fiber wound into a cheese shape, having a breaking elongation of 50–120%, a dry heat shrinkage extreme stress of 0–0.15 cN/dtex, and a boiling water shrinkage of 1–10%.

17. The method of claim 14 or 15, wherein both of the two polyester components are both poly(trimethylene terephthalate) homopolymers; and the differnce in intrinsic viscosity between the two polyester components is 0.3–0.5 (dl/g).

18. The method of claim 14 or 15, wherein both of the two polyester components are poly(trimethylene terephthalate) homopolymers with a trimethylene terephthalate cyclic dimer content of no greater than 2.5 wt %.

* * * * *